US008162043B2

(12) United States Patent
Burnham et al.

(10) Patent No.: US 8,162,043 B2
(45) Date of Patent: Apr. 24, 2012

(54) IN SITU METHOD AND SYSTEM FOR EXTRACTION OF OIL FROM SHALE

(75) Inventors: Alan K. Burnham, Livermore, CA (US); Roger L. Day, Rifle, CO (US); P. Henrick Wallman, Berkeley, CA (US); James R. McConaghy, Salida, CO (US)

(73) Assignee: American Shale Oil, LLC, Newark, NJ (US)

( * ) Notice: Subject to any disclaimer, the term of this patent is extended or adjusted under 35 U.S.C. 154(b) by 0 days.

(21) Appl. No.: 13/039,847

(22) Filed: Mar. 3, 2011

(65) Prior Publication Data

US 2011/0174496 A1 Jul. 21, 2011

Related U.S. Application Data

(60) Division of application No. 12/779,791, filed on May 13, 2010, now Pat. No. 7,921,907, which is a continuation-in-part of application No. 11/655,152, filed on Jan. 19, 2007, now Pat. No. 7,743,826.

(60) Provisional application No. 60/760,698, filed on Jan. 20, 2006, provisional application No. 61/178,856, filed on May 15, 2009, provisional application No. 61/328,519, filed on Apr. 27, 2010.

(51) Int. Cl.
*E21B 43/24* (2006.01)

(52) U.S. Cl. ..... 166/57; 166/245; 166/248; 166/307

(58) Field of Classification Search ..... 166/266, 166/272.1, 272.3–272.7, 244.1
See application file for complete search history.

(56) References Cited

U.S. PATENT DOCUMENTS

| | | | |
|---|---|---|---|
| 5,816,325 | A | 10/1998 | Hytken |
| 6,712,136 | B2 | 3/2004 | de Rouffignac et al. |
| 6,896,053 | B2 | 5/2005 | Berchenko et al. |
| 6,991,032 | B2 | 1/2006 | Berchenko et al. |
| 6,997,518 | B2 | 2/2006 | Vinegar et al. |
| 7,743,826 | B2 | 6/2010 | Harris et al. |
| 2002/0074122 | A1 | 6/2002 | Kelley et al. |
| 2007/0045266 | A1 | 3/2007 | Sandberg et al. |

OTHER PUBLICATIONS

Hytken, K., Fax Transmittal Sheet to Glenn Caldarola at the U.S. Patent & Trademark Office dated Jun. 17, 2009.
Garrouch, A.A., et al., "Journal of Petroleum Science and Engineering", vol. 44, 2004, pp. 283-301.
Burnham, A.K., et al., "High Pressure Pyrolysis of Green River Oil Shale," ACS Symp. Series 230, Geochemistry and Chemistry of Oil Shales, 1983, pp. 355.
Prats, M., et al., "Soluble-Salt Processes for In-Situ Recovery of Hydrocarbons from Oil Shale", J. Petr. Tech. vol. 29, 1977, pp. 1078-1088.

(Continued)

*Primary Examiner* — Walter D Griffin
*Assistant Examiner* — Brian McCaig
(74) *Attorney, Agent, or Firm* — Holland & Hart LLP

(57) ABSTRACT

A process for retorting and extracting sub-surface hydrocarbons. The process comprises drilling an energy delivery well extending from the surface to a location proximate a bottom of the hydrocarbons. The hydrocarbons are heated from the bottom to form a retort, the retort extending along a portion of the energy delivery well. A vapor tube is extended to a location proximate the retort, the vapor tube having an entrance corresponding to the region of the retort along the energy delivery well that is nearest the surface exit.

7 Claims, 23 Drawing Sheets

OTHER PUBLICATIONS

Ramey, M., et al., "The History and Performance of Vertical Well Solution Mining of Nahcolite (NaHCO3) in the Piceance Basin, Northwestern Colorado, USA". In: Solution Mining Research Institute, 2004 Fall Meeting, Berlin, Germany.

Forsberg, C.W., "High-Temperature Reactors for In-Situ Recovery of Oil from Shale", Oak Ridge National Laboratory, U.S. Department of Energy, Address delivered at 2006 International Congress on Advances in Nuclear Power Plants, Jun. 7, 2006, Reno, Nevada.

U.S. Department of Energy, Office of Fossil Energy, "Microhole Technology: A Systems Approach," Mar. 2006, available at www.netl.doe.gov/technologies/oil-gas/publications/brochures/microhole2006_mar.pdf).

U.S. Department of Energy, Office of Fossil Energy, "Microhold Systems R&D," available at www.fossil.energy.gov/programs/oilgas/microhole/index.html.

www.naturalgas.org/naturalgas/well_completion.asp.

http://en.wikipedia.org/wiki/oil_well#completion.

IN SITU METHOD AND SYSTEM FOR EXTRACTION OF OIL FROM SHALE

CROSS-REFERENCE TO RELATED APPLICATIONS

The present application is a divisional application of U.S. Application No. 12/779,791, filed May 13, 2010, U.S. Pat. No. 7,921,907, which is a continuation in part of U.S. Application No. 11/655,152, filed Jan. 19, 2007, U.S. Pat. No. 7,743,826, which claims the benefit of U.S. Provisional Application No. 60/760,698, filed Jan. 20, 2006, the disclosures of which are hereby incorporated by reference in their entirety. U.S. Application No. 12/779,791 also claims the benefit of U.S. Provisional Application No. 61/178,856, filed May 15, 2009 and U.S. Provisional Application No. 61/328,519, filed Apr. 27, 2010, the disclosures of which are hereby incorporated by reference in their entirety.

BACKGROUND

Large underground oil shale deposits are found both in the U.S. and around the world. In contrast to petroleum deposits, these oil shale deposits are characterized by their solid state; in which the organic material is a polymer-like structure often referred to as "kerogen" intimately mixed with inorganic mineral components. Heating oil shale deposits to temperatures above about 300 C. for days to weeks has been shown to result in pyrolysis of the solid kerogen to form petroleum-like "shale oil" and natural gas like gaseous products. The economic extraction of products derived from oil shale is hindered, in part, by the difficulty in efficiently heating underground oil shale deposits.

Thus there is a need in the art for a method and apparatus that permits the efficient in-situ heating of large volumes of oil-shale deposits.

SUMMARY

The systems and processes disclosed herein embody several objectives, advantages, and/or features as follows:

Operation of the retort in a mode in which the outlet of the retort is sufficiently far from the active retorting zone that the level of the oil pool is maintained by condensation of oil, which returns by gravity-driven flow to the oil pool.

Operation of the retort in a mode in which the pressure of the retort is maintained at a level that is sufficient to condense oil vapor within the retort and returns by gravity-driven flow to maintain the level of the boiling oil pool.

Operation of the retort in a mode in which liquid oil is returned from the surface to maintain the level of the boiling oil pool.

Operation of the retort in a mode in which liquid oil of the correct boiling point distribution is used to maintain proper boiling distribution in the oil pool to optimize the delivery of heat from the boiling oil pool to the retort.

Operation of the retort in a mode in which the oil returned from the surface cools the gases and vapors exiting the retort and causes additional oil to condense and return to the boiling oil pool by gravity-driven flow.

Operation of the retort in a mode in which a combination of return of oil from the surface, countercurrent heat exchange between returning oil and escaping vapors, and pressure in the retort are used to maintain the proper level and composition in the boiling oil pool.

Structure in which vertical spider wells are used to distribute the boiling oil within a thick oil shale resource.

Structure in which the heater is contained in an inclined borehole to facilitate drainage of oil into a boiling oil pool.

The present application is directed to a system and process for extracting hydrocarbons from a subterranean body of oil shale within an oil shale deposit located beneath an overburden. The system comprises an energy delivery subsystem to heat the body of oil shale and a hydrocarbon gathering subsystem for gathering hydrocarbons retorted from the body of oil shale.

The energy delivery subsystem comprises at least one energy delivery well drilled from the surface of the earth through the overburden to a depth proximate a bottom of the body of oil shale, the energy delivery well extending generally downward from a surface location above a proximal end of the body of oil shale to be retorted and continuing proximate the bottom of the body of oil shale. The energy delivery well may extend into the body of oil shale at an angle.

The energy delivery well comprises a heat delivery device extending in part beneath and across the body of oil shale to be retorted, from the proximal end thereof to the distal end thereof. The heat delivery device is adapted to deliver to the body of oil shale to be retorted heat energy at a temperature of at least a retorting temperature.

The heat delivery device comprises a fluid transmission pipe extending along the bottom of the body of oil shale. The fluid transmission pipe is adapted to receive a heating fluid heated to at least a retorting temperature and to deliver heat energy from the heating fluid to the body of oil shale. In one embodiment, the fluid transmission pipe receives and transmits a first heating fluid at a first phase of operation of the system and the fluid transmission pipe receives and transmits a second heating fluid at a second phase of operation of the system. The fluids may be the same or different. For example, the fluid may be steam or a high-temperature medium.

The system may further comprise at least one vapor conduit drilled through the body of oil shale to be retorted. The vapor conduit having a lower end located at approximately the bottom of the body of oil shale to be retorted. The vapor conduit is adapted to carry vapor from oil shale retorted by the heat delivery subsystem upward through the body of oil shale. The vapor conduit may also permit the vapor to pass between the vapor conduit and the body of oil shale proximate to the vapor conduit. The vapor conduit also permits the vapor to provide heat energy to the oil shale as the vapor ascends therethrough, the heat energy provided at least in part by refluxing.

The vapor conduit is at least in part an open hole and gravel packed to provide integrity to the vapor conduit and permeability to the movement of retort vapors and liquids. The vapor conduit is at least in part cased with a casing perforated to permit retort vapors and liquids to pass between the vapor conduit and the body of oil shale to be retorted. The vapor conduit may be in the form of a spider well.

The hydrocarbon gathering subsystem comprises at least one cased well drilled into the earth through the overburden, and through the body of oil shale to be retorted. The cased well having an upper end located at the surface of the earth, the cased well extending through the overburden at least to the bottom of the overburden. The hydrocarbon gathering subsystem also comprises a production tube having a collection end at the upper end of the cased well and having a gathering end located at the bottom of the body of oil shale to be retorted, the production tube adapted for transmitting liquid hydrocarbons therethrough.

A sump is located below and communicating with the gathering end. The sump is adapted for collecting condensed liquid hydrocarbons retorted from the oil shale deposit and to permit liquid hydrocarbons to be pumped from the sump into the gathering end of the production tube.

Also contemplated, is a process for retorting and extracting sub-surface hydrocarbons. The process comprises drilling an energy delivery well extending from the surface to a location proximate a bottom of the hydrocarbons. The hydrocarbons are heated from the bottom to form a retort, the retort extending along a portion of the energy delivery well. A vapor tube is extended to a location proximate the retort, the vapor tube having an entrance corresponding to the region of the retort along the energy delivery well that is nearest the surface exit.

In a first phase the process includes maintaining the temperature of vapor entering the entrance at a temperature approximately equal to unheated surrounding hydrocarbons. The process includes a second phase that includes further heating the retort until the vapor entering the entrance reaches a temperature of between about 180 to 290 degrees C. at a pressure of between about 150 to 1100 psig. A third phase includes further heating the retort to between about 325 and 350 degrees C.

The process preferably includes positioning a heater in the energy delivery well, and may include moving the entrance of the vapor tube away from the heater as a function of time. The process may include recycling oil into the retort. Oil may be removed from the retort to the surface and recycled back to the retort as needed. and removing excess water from the retort.

In another embodiment, the process for retorting and extracting sub-surface hydrocarbons from an oil shale formation comprises drilling a well extending from a proximal end located at the surface to a distal end extending into the formation at an angle. Positioning a heater near the distal end of the well and within the formation. Extending tubing along the well and spalling the formation by heating the formation in excess of 82 degrees C. Voidage for continued spalling is created by removing oil and gas produced from heating the formation through the tubing.

DETAILED DESCRIPTION

The present invention relates to the in-situ heating and extraction of shale oil, and particularly to a Conduction, Convection, Reflux (CCR™) retorting process. It should be noted at the outset that while the embodiments described herein may relate to a particular formation, the CCR™ retorting process may be applicable to other formations. Furthermore, the embodiments are described in terms of relatively small scale test production and production and capacity ranges disclosed may be scaled up or down depending on the circumstances.

In one example the CCR™ retorting process is implemented in Colorado's Piceance Basin. Specifically, the process is implemented in the illite-rich mining interval in the lower portion of the Green River Formation below the protected aquifers. In this embodiment, the mining interval is an approximately 500-ft thick section extending from the base of the nahcolitic oil shale (1850 feet approximate depth) to the base of the Green River Formation (2350 feet approximate depth). Retorts will be contained within the mining interval.

Characterization of illite oil shale samples indicates that the kerogen quality is similar to that from the carbonate oil shale from higher strata. The fractional conversion of kerogen to oil during Fischer Assay is nearly the same for both carbonate and illite oil shales. The oil retorted from illite oil shale contains slightly more long-chain alkanes (wax) than in typical Mahogany Zone (carbonate) oil shale. These long-chain alkanes are actually beneficial as they boil at a higher temperature, thus enhancing the reflux action in the CCR™ retorting process, which is described more fully below.

Figure 1:
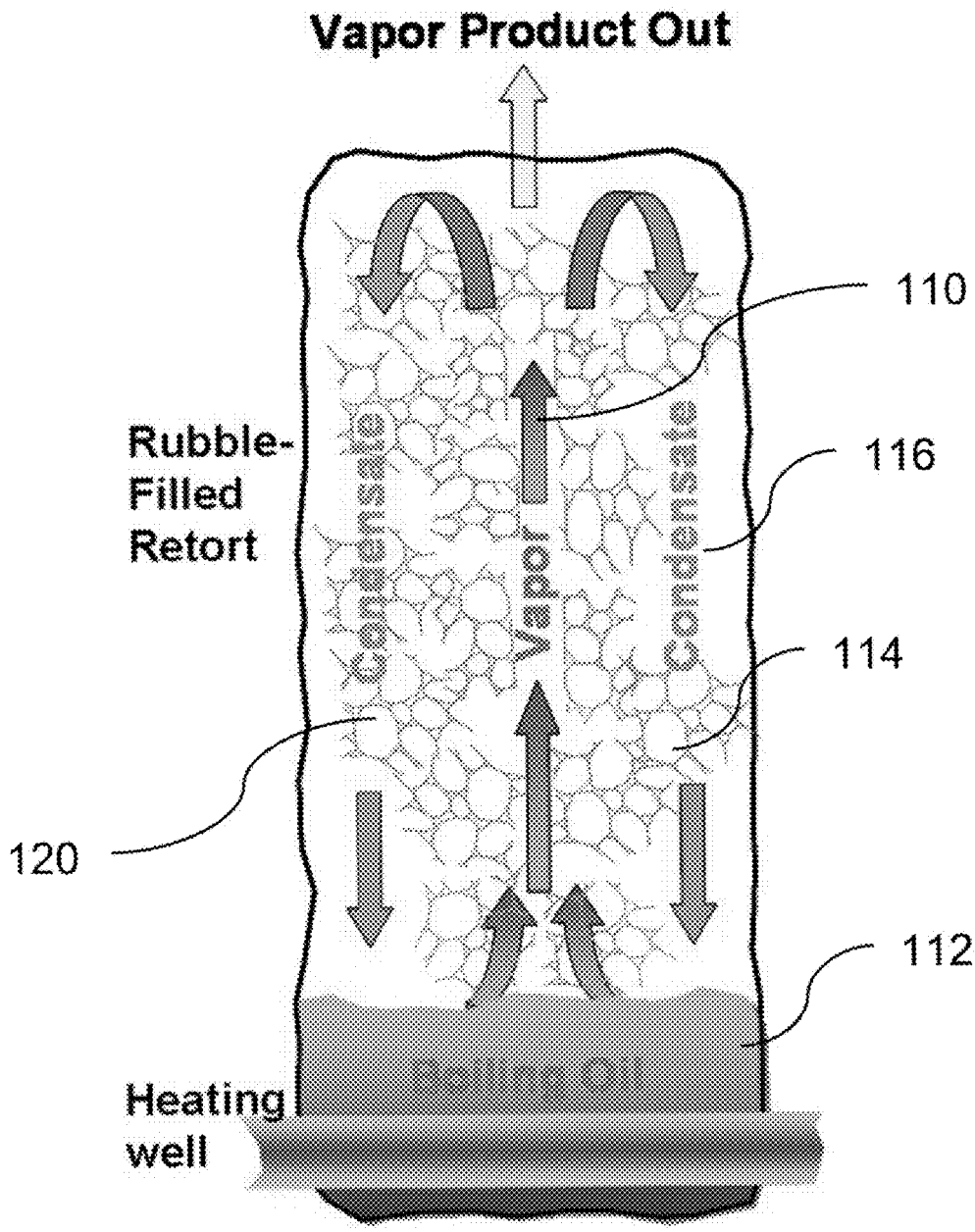
FIG. 1 is a schematic representation of an embodiment of the CCR™ Process as adapted to take advantage of thermomechanical fragmentation.

The CCR™ process uses a boiling pool of shale oil in the bottom of the retort in contact with a heat source, as shown schematically in FIG. 1. Hot vapors 110 evolving from the boiling shale oil 112 heat the surrounding oil shale 114 with both their sensible heat and latent heat of condensation as they recirculate through the retort by dual-phase natural convection. As the oil shale nearest the evolving hot vapors reaches temperatures between about 300 and 350 C., depending upon the time of heating, kerogen is retorted. As oil shale is heated to retort temperature, thermal expansion, in combination with geomechanical confinement by the surrounding formation, causes it to break apart (spall) at the retort boundary, resulting in a debris filled retort 120. As the oil shale spalls, more oil shale is exposed to the hot vapors 110. As these hot vapors condense on the freshly exposed oil shale, rapid retort growth may occur. The condensed shale oil 116 drains and replenishes the boiling pool; generally referred to as a reflux process. Vapors that do not condense at retort temperature report to the surface.

Heat is required to boil the pool of shale oil in the bottom of the retort. Variations of the CCR™ process involve different ways of heating the boiling oil pool. This heat can be applied using several methods.

Downhole Heat Sources A conventional burner or catalytic heater may be used to burn methane, propane, or treated shale fuel gas to provide heat to the boiling pool of shale oil. The burner or heater would be contained in a casing that is submerged in the boiling pool. Flue gases would not be allowed to co-mingle with retort products. An electric resistance heater or radio frequency antenna could be used in lieu of either the burner or catalytic heater.

Surface Heat Sources Any number of fluids (steam, gases, and certain liquids) could be heated on the surface using boilers or other methods to heat the fluids. These hot fluids would be circulated to a heat exchanger submerged in the boiling pool. Alternatively, retort products can be collected on the surface, heated to appropriate temperatures, and sparged into the boiling pool. The process could be started with hot gas sent from the surface to generate enough shale oil to initiate the CCR™ convection loop.

Once the CCR™ retorting process is operational, a surface cooling/condensing process will result primarily in the production of shale oil, shale fuel gases, and water. The shale fuel gases can be used to create retort heat, fire surface process heaters, and produce steam and/or electricity.

Figure 2:
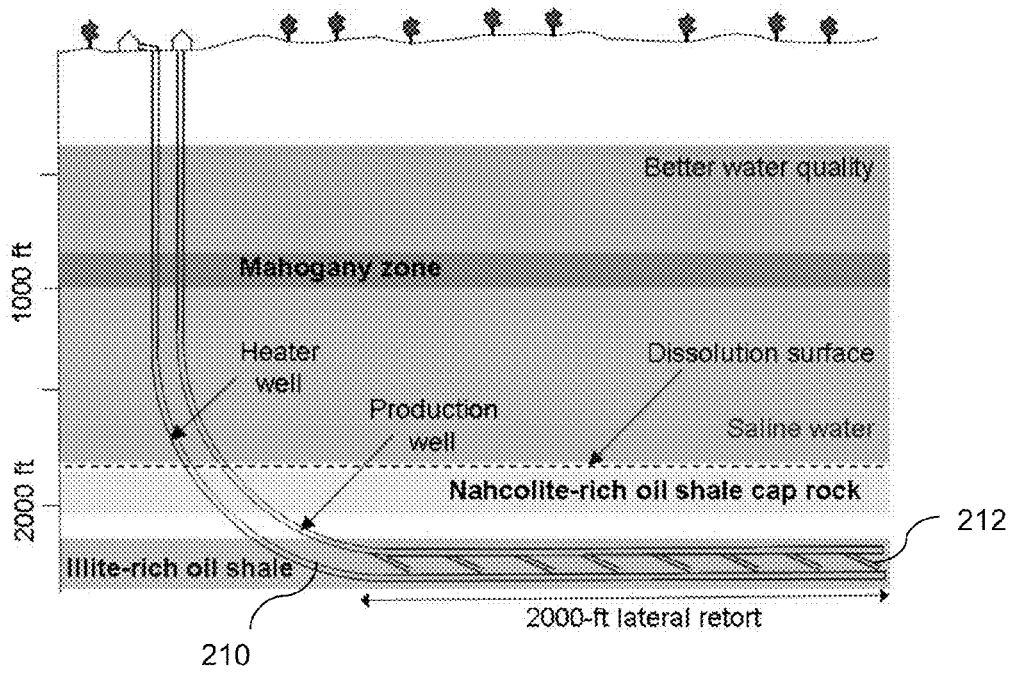
FIG. 2 is a schematic representation of an embodiment of the CCR™ process as implemented in the Illite Mining Interval.

The CCR™ process can be operated in a variety of geometries. One form of a CCR™ retort is a horizontal borehole where the boiling shale oil pool is distributed over a long horizontal section at the bottom of the mining interval. This concept is shown schematically in FIG. 2. A horizontal well 210 may be "U" shaped. "J" shaped, or "L" shaped as created by directional drilling. In each case, those portions of the well that deviate from vertical to create horizontal boreholes would be completed at the bottom of the retort interval 212. Another form of a CCR™ retort is a vertical borehole where the boiling shale oil pool occupies the lower portion. Combinations of these vertical, horizontal, as well as inclined boreholes may be used as necessary to enhance resource recovery, improve commercial viability, and reduce environmental impacts to the surface and subsurface for practical commercial operations.

Figure 3:
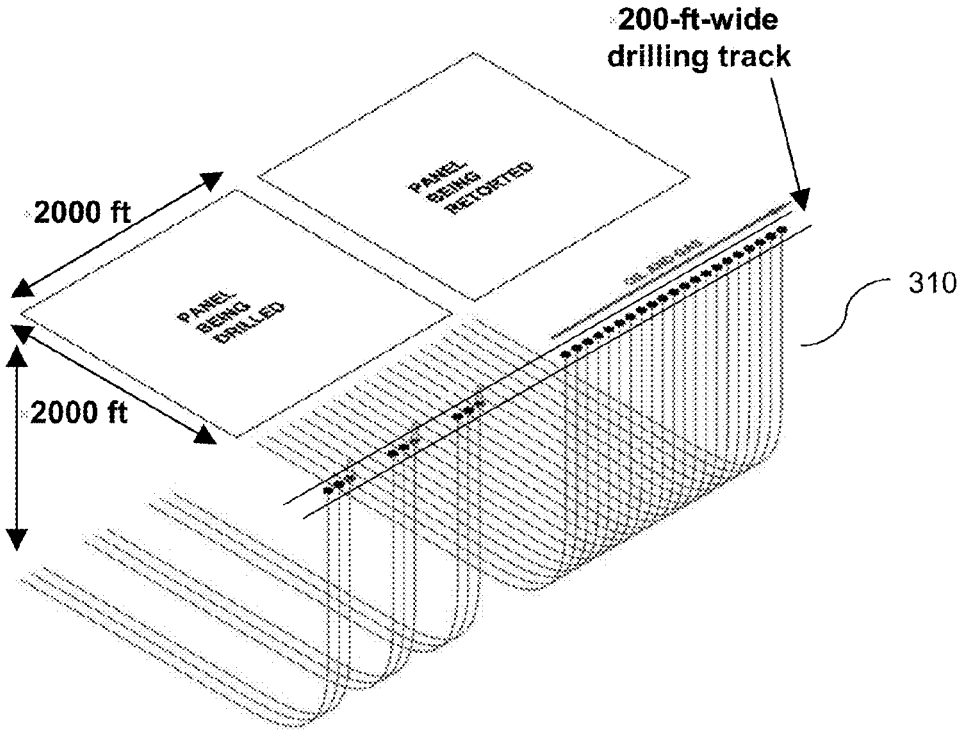
FIG. 3 is an exemplary conceptual layout for commercial operations using some optimized configurations of parallel heat and production wells in the Illite Mining Interval.

One approach for commercial operations is shown in FIG. 3. About 20 well pairs separated by 100-ft make up a retort panel 310. The panels are separated by a narrow strip of unretorted shale for a permeation barrier. Heat is provided by a downhole burner. Countercurrent heat exchange occurs between the outgoing flue gas and incoming air and fuel. Oil, gas, and water are produced both as liquids and vapors. An above ground facility processes the produced fluids, separating them into components to be shipped or pipelined to upgrading facilities or commercial markets.

The CCR™ process is designed to efficiently recover oil and gas from oil shale. While there are variations in the embodiments of the process they all generally include delivery of heat to the formation via indirect heat transfer using electromagnetic energy or a closed system that either circulates a heated fluid (steam or a high-temperature medium such as Dowtherm®, which is available from Dow Chemical Company) or generates hot gas or steam by means of a downhole combustor. This approach minimizes potential contamination and environmental problems for both surface as well as subsurface hydrology. The CCR™ process also generally includes distribution of the heat through the formation by reflux-driven convection as explained above. This approach uses the generated oil to rapidly distribute the heat from the closed heat-delivery system to the formation, thereby causing more oil to be formed. Further heat distribution occurs by conduction. One variation of the CCR™ process extends the oil reflux loop to a surface heater, but no foreign materials are introduced.

Figure 4:
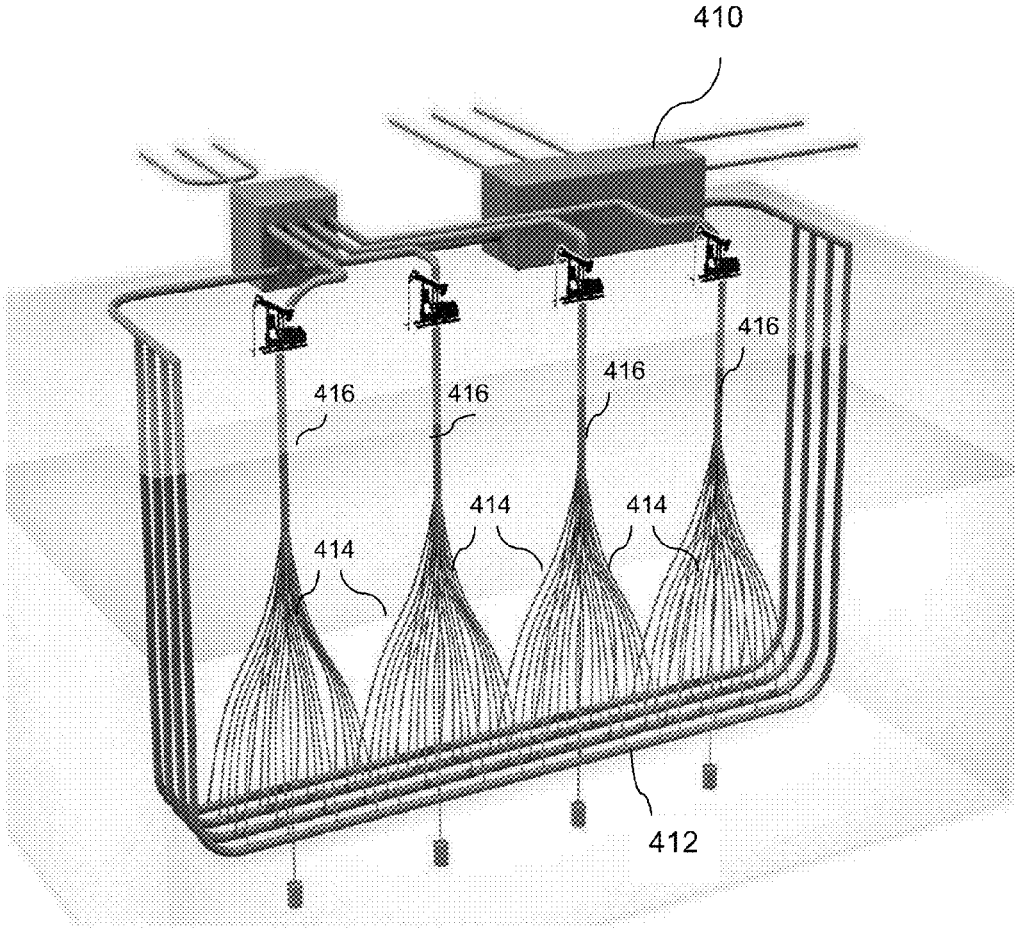
FIG. 4 is a schematic diagram of an exemplary embodiment of the CCR™ process.

In one embodiment, the process is designed to process thick oil-shale sections with modest overburden thicknesses. The energy system involves multiple, directionally drilled heating wells that are drilled from the surface to the oil shale zone and then return to the surface. These wells are cased, partially cemented, and form part of a closed system through which a heat transfer medium is circulated. Commercially, the input heat source would be by combustion of retort gas in a boiler/heater system 410. The oil generation/production system is designed to transfer heat efficiently into the formation and to collect and maximize recovery of hydrocarbon products. The production wells 416 could be drilled via coiled tubing drilling system through a large diameter, insulated conduit pipe, which would minimize the surface footprint and reduce environmental impact of the recovery system. A schematic diagram showing this embodiment of the energy delivery and product delivery systems are shown in FIG. 4.

One of the key issues affecting the economic success of oil shale processes is the rate at which heat can be extracted from the horizontal heating pipe 412 and transferred to the region above to be retorted. The region around the horizontal pipe is surrounded by boiling oil. In one embodiment, oil vapors travel up the spider wells 414 (see FIG. 4) and condense on the well bore 416, thereby delivering their heat of vaporization on the well wall. The heat diffuses laterally away from the well by thermal conduction, thereby heating the region between the wells.

Figure 5:
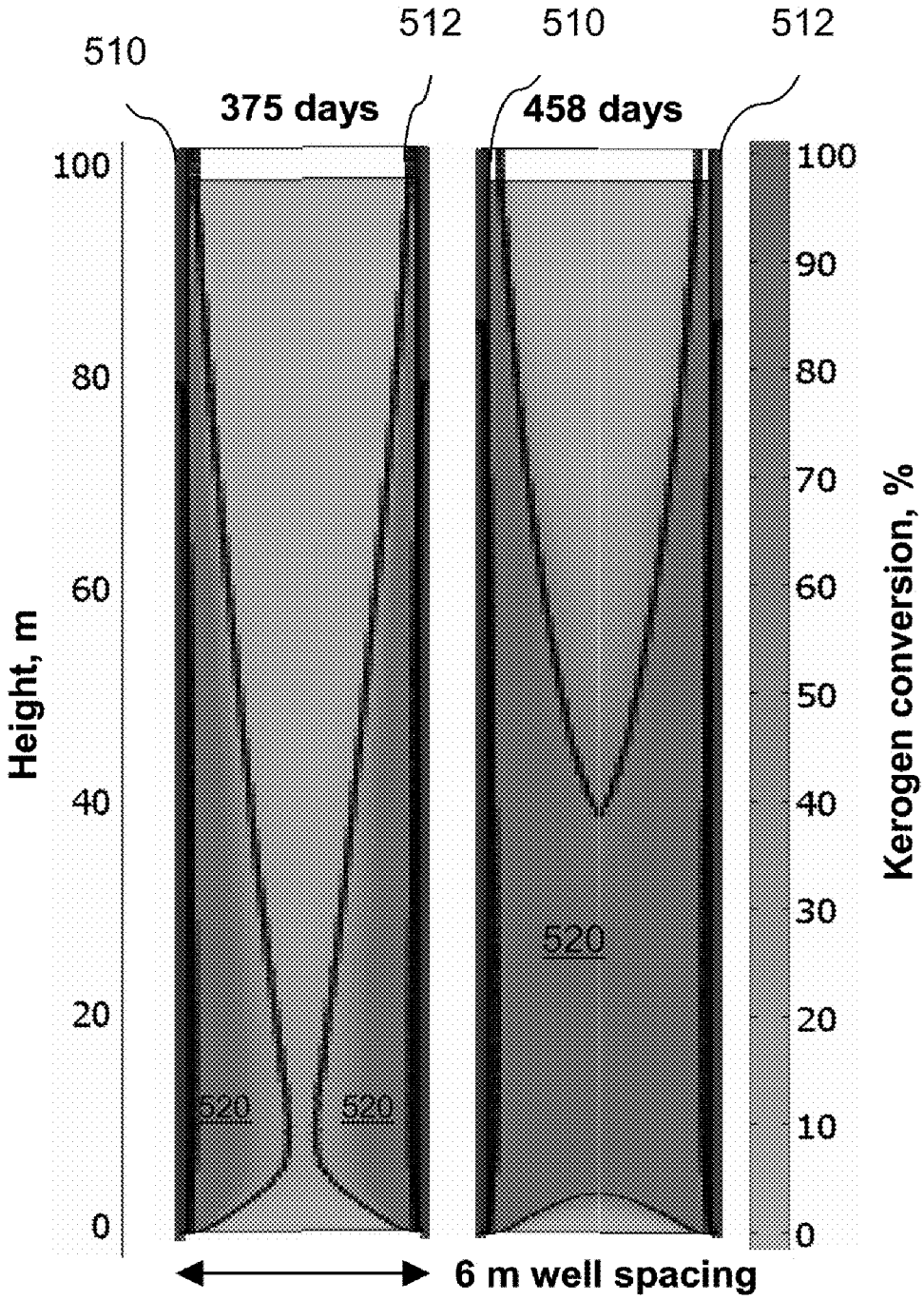
FIG. 5 shows kerogen conversion profiles between two wells at two selected times, assuming no bole-hole fragmentation.

Model calculations were used to estimate profiles of the amount of kerogen converted to oil and gas between two wells. FIG. 5 graphically represents kerogen conversion profiles between two wells 510 and 512 at two selected times, assuming no bore-hole fragmentation. The fully retorted regions 520 join midway between the two wells at about 390 days and then continue upward in a U-shaped retorting front.

At 833 days, ~85% of the kerogen is converted when depletion of the refluxing oil pool occurs. Most of the unconverted kerogen is in the middle, top region. If the field is left dormant (no cooling, no heating) for an additional 3 months, another 1.5% kerogen conversion occurs. If one attains 80% of Fischer Assay by volume from the converted kerogen, as suggested by experiments at Lawrence Livermore National Laboratory and Shell Oil, approximately 70% of the oil in the retort region can be recovered. (See A. K. Burnham and M. F. Singleton, "High Pressure Pyrolysis of Green River Oil Shale," ACS Symp. Series 230, *Geochemistry and Chemistry of Oil Shales* (1983), p. 355; U.S. Pat. No. 6,991,032 the disclosures of which are hereby incorporated by reference in their entirety.)

Once started with a heat source, such as imported natural gas, the retorting process is self-sustaining. In addition to shale oil, about $\frac{1}{6}^{th}$ of the kerogen is converted to a fuel gas. (This corresponds to about $\frac{1}{4}^{th}$ of the total hydrocarbons recovered, because a third of the kerogen is converted to coke.) Although this fuel gas may require scrubbing to remove $H_2S$ and other sulfur gases prior to combustion, for oil shale grades in excess of about 20 gal/ton, the gas contains sufficient energy to sustain the retort operation, including vaporization of formation water that cannot be pumped out prior to heating.

In another embodiment, L-shaped wells are used instead of the U-shaped wells shown in FIG. 4. L-shaped wells have the advantage during commercial development of allowing retorted panels to be closer together and reduce surface disturbance and impacts on other underground resources. The L-shaped wells also have the potential to be less expensive to complete. The way the retort works is unchanged, i.e., heat is transferred from a horizontal well section to a boiling oil pool and is distributed through the retort by way of refluxing oil. Production can still occur through vertical production wells, although horizontal production wells may have other advantages. L-shaped wells are also amenable to the use of alternative heating sources such as downhole combustion heaters and electric heaters of various types.

Downhole burners are of particular interest here, because they increase energy efficiency substantially by reducing heat losses to the overburden. Not only are heated fluids traveling only in one direction, there is a counter-current heat exchange between incoming air/fuel and outgoing flue gas. This improvement in energy efficiency is particularly important for a plan targeting the illite-mining interval, for which the overburden thickness is substantial.

A variety of downhole burner technologies may be used. In one case, water is delivered along with the fuel gas and air to form a steam-rich combustion gas. The water keeps the flame region cool to minimize material erosion and enhances heat transfer to the horizontal portion of the heat delivery system. As another example, catalytic combustion occurs over a substantial length of the heat delivery system.

Figure 6:
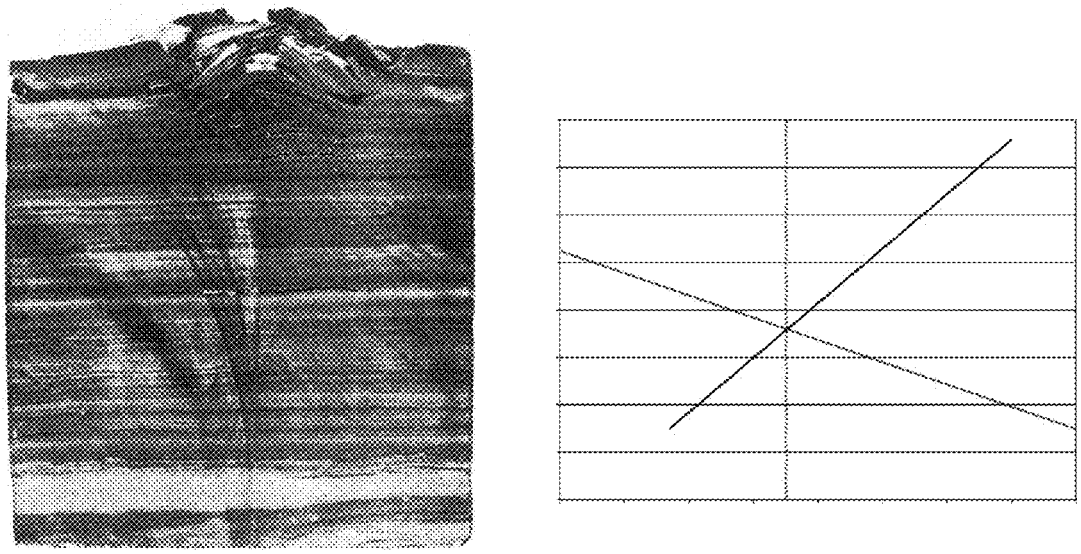
FIG. 6 illustrates thermomechanical fragmentation that occurs while stress increases with temperature and strength decreases with temperature.

The CCR™ retorting process also takes advantage of the geomechanical forces that exist in oil shale formations. It has been found that the geomechanical forces at depth cause the oil shale to fracture and spall when heated below retorting temperatures, as shown in FIG. 6. In an article appearing in the Journal of Petroleum Technology by Prats et al., which is hereby incorporated by reference in its entirety, a test was conducted on a block that was a 1-ft cube heated with one face exposed to steam flowing at 520° F. (Prats, M., P. J. Closmann, A. T. Ireson, and G. Drinkard (1977) Soluble-Salt Processes for In-Situ Recovery of Hydrocarbons from Oil Shale, J. Petr. Tech. 29, 1078-1088) ("Prats (1977)"). The block was confined on all faces except the one that was exposed to heat and underwent fragmentation. The fragmentation occurs because the stress increases with temperature while the strength decreases with temperature. The stress exceeds strength at about 180° F. Given enough initial void in a well, the permeability of the surrounding formation will increase due to this thermal fragmentation, thereby enabling the reflux-driven convection mechanism to efficiently deliver heat to the cold shale near the edge of the retorted zone.

Figure 7:
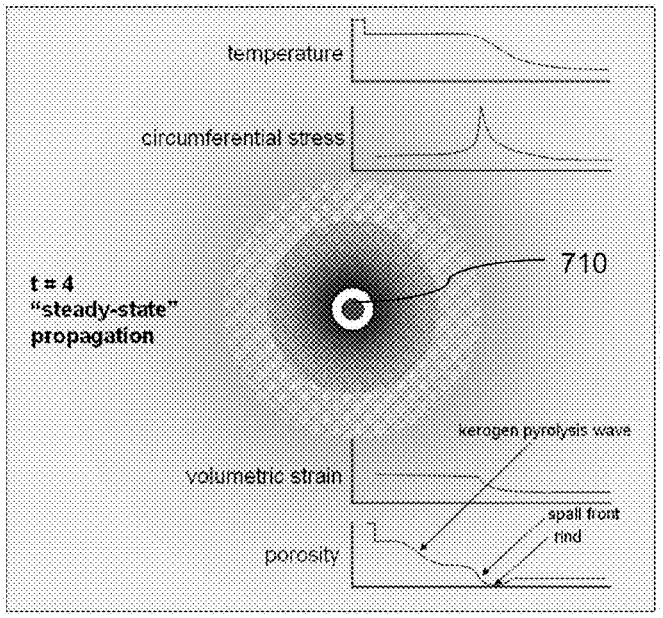
FIG. 7 illustrates the propagation of a thermomechanical fragmentation wave from a heating well.

Kerogen constitutes about 30% by volume of the oil shale in the retort interval. As the kerogen is converted to oil and gas, porosity is created in the shale. This porosity provides an unconfined surface at the retort boundary, thus allowing for rapid propagation of the retort by thermal fragmentation (spalling). This overall process is shown schematically in cylindrical geometry in FIG. 7. FIG. 7 shows the propagation of a thermomechanical fragmentation wave from a heating well 710. The heat well 710 is shown in the center and goes into and out of the plane of the page.

Due to external confinement by the surrounding formation, the thermal expansion just outside the retort region is expected to cause the oil shale to compact, thus closing fractures and small pores within the oil shale. This compaction is expected to result in a nearly impermeable "rind", which would help exclude free formation water and confine retort products. This rind will enhance the naturally occurring containment provided by the low permeability of the mining interval.

Figure 8:
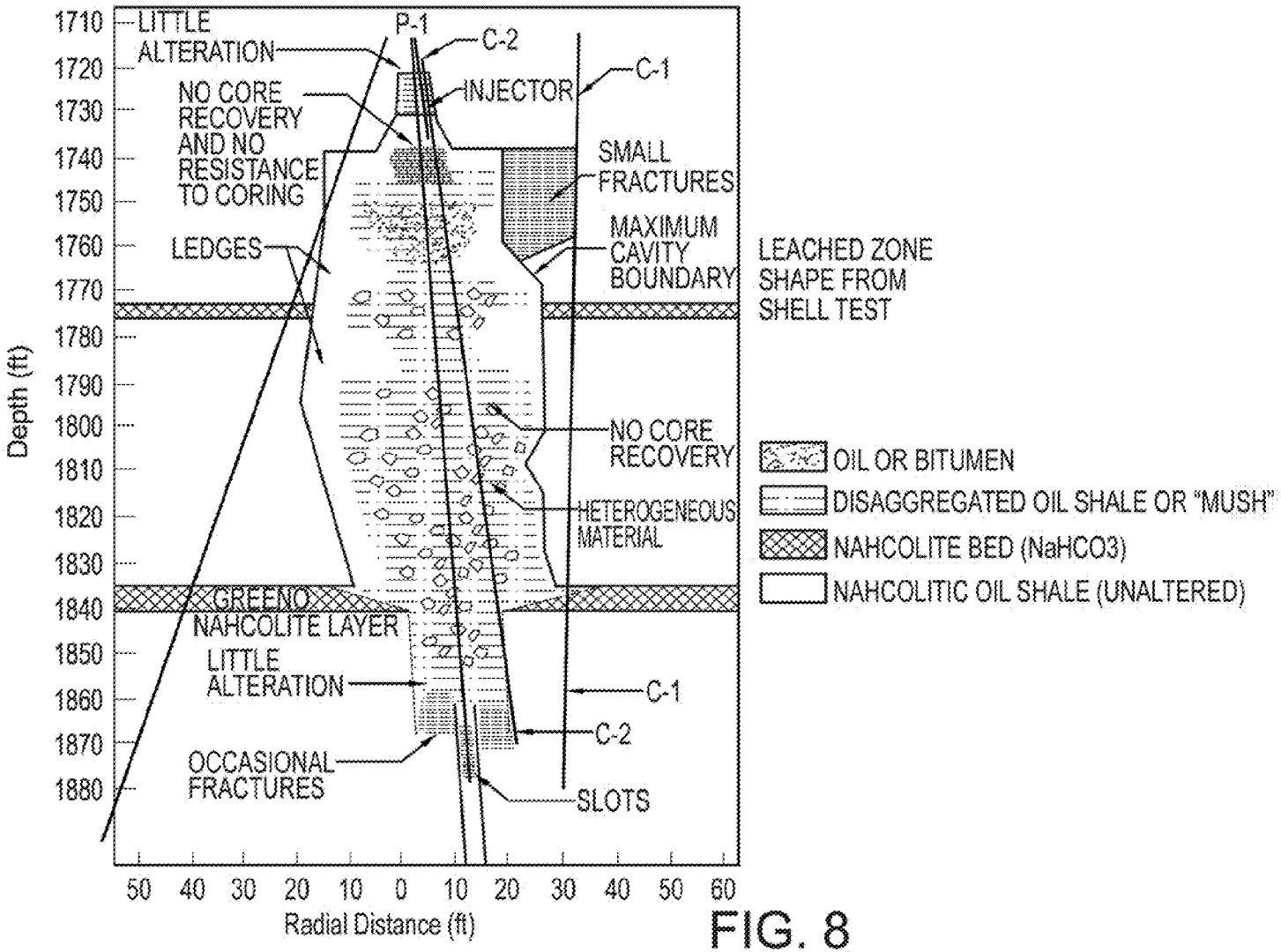
FIG. 8 represents a large oil shale retorting cavity formed by thermomechanical fragmentation.

It has been found that large cavities can be formed by propagation of thermomechanical fragmentation. In one demonstration as described in Prats (1977), the rubble cavity grew to a diameter of about 15 ft. The cavity description is reproduced in FIG. 8. In this case, the voidage for continued spalling was created by removal of nahcolite and conversion of kerogen to oil and gas.

It has been found that cavities formed during nahcolite recovery by this spalling mechanism readily grow to 300 ft and averaged nearly 200 ft in diameter. The CCR™ retorting process takes advantage of the thermal fragmentation mechanism. However, the CCR™ process uses the kerogen recovery void space instead of the nahcolite dissolution void space to sustain continued rubblization.

Shown in Table 1 are cavity diameters formed by thermal fragmentation during recovery of nahcolite by high-temperature solution mining as reported in a paper by Ramey and Hardy, the disclosure of which is hereby incorporated by reference in its entirety. (Ramey, M., and M. Hardy (2004) The History and Performance of Vertical Well Solution Mining of Nahcolite (NaHCO3) in the Piceance Basin, Northwestern Colorado, USA. In: Solution Mining Research Institute, 2004 Fall Meeting, Berlin, Germany). CCR™ retorts are expected to achieve comparable diameters given adequate convective heat transfer via oil refluxing.

TABLE 1

| Well | Tons of $NaHCO_3$ Recovered | Cavity Diameter (ft) |
|---|---|---|
| 20-14 | 181,682 | 171 |
| 29-24 | 176,604 | 205 |
| 29-29 | 143,760 | 178 |
| 20-30 | 131,643 | 171 |
| 29-34 | 126,910 | 168 |
| 29-23 | 123,651 | 168 |
| 20-36 | 123,097 | 166 |
| 28-21 | 117,551 | 169 |
| 21-16 | 113,420 | 153 |
| 20-32 | 113,160 | 158 |

The spalling phenomenon affects the optimum well design and spacing. The small-bore spider wells 414 (see FIG. 4) may tend to fill with rubble debris, which could reduce the permeability in the vicinity of the original well. However, the permeability will probably be greater in the surrounding formation than assumed in the calculations shown in FIG. 5, which will influence the heat distribution by refluxing. Consequently, the process may work as well or better with fewer, larger, vertical production wells, and the retort zone may be more likely to grow cylindrically around and above the horizontal heating well.

The CCR™ process depends upon the maintenance of a boiling oil pool in contact with the heater. In principle, pressure can be used as a process parameter to control the amount of oil in the pool. However, pressure also affects the temperature required for oil boiling. This constrains the available operational parameter space available to optimize heat transfer from the heater to the surrounding formation.

In addition, the water content of the rock affects the ability to maintain the boiling oil pool. Oil vapors can be swept out of the retort by an inert gas such as steam; if the production tubing is at a temperature above the dew point of oil vapors in the gas mix, the oil is swept out of the retort and can no longer participate in the refluxing process. Consequently, replenishment of the oil pool by recycling oil from the surface may become necessary. This effect is largest at small scale (e.g., for a pilot test and during startup of a larger test), because the amount of shale from which water is vaporized is considerably larger than the amount retorted. This is because of a approximately constant thickness of shale that has been dried but not retorted at the boundary of the retort.

Heat input to the retort region may be supplemented by recycling hot oil into the retort. This requires the temperature of the injected oil to exceed the temperature of oil vapors being produced. Also, it requires managing heat loss from the well through which the recycling occurs for both formation damage and thermal efficiency reasons.

Figure 9:
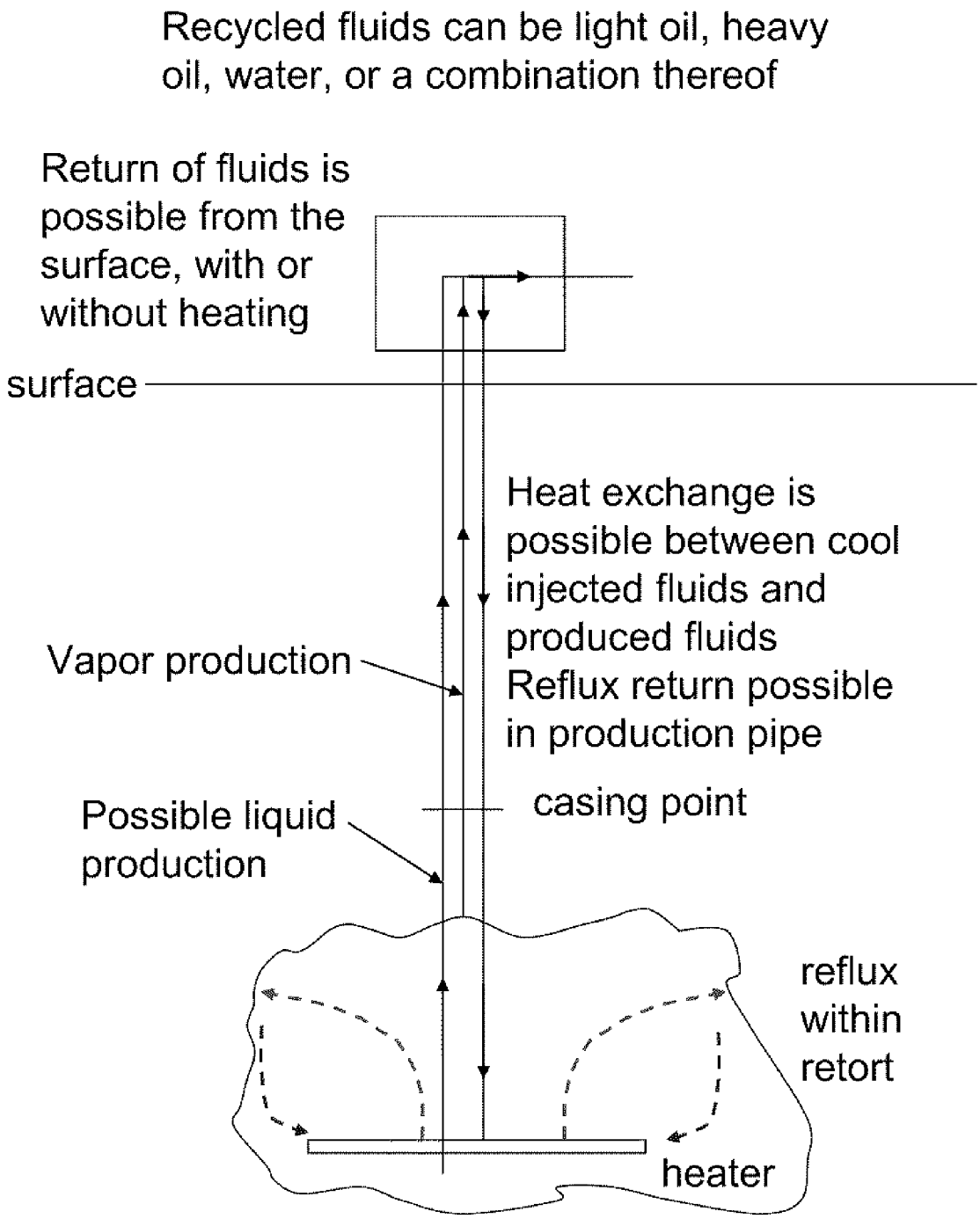
FIG. 9 represents a generalized CCR™ process using recycle from the surface in addition to reflux within the retort.

A schematic representation of the CCR™ process is shown in FIG. 9. This process has the advantages of being able to optimize retort pressure independently, compensate for oil vapors removed by steam, and increase the amount of heat input using hot oil recycling.

Figure 10:
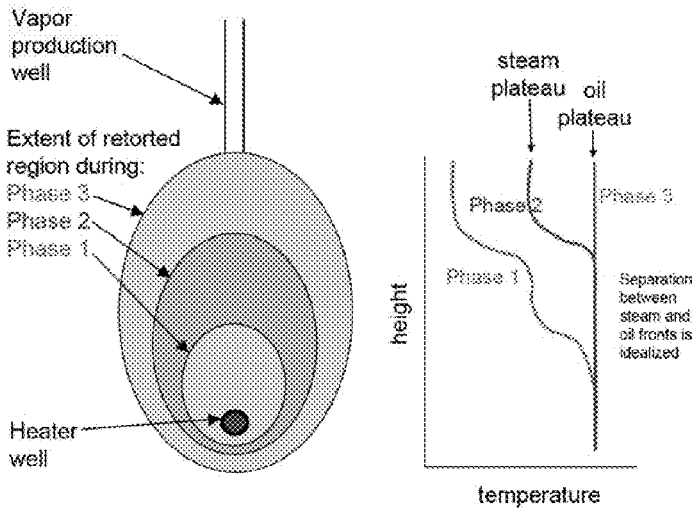
FIG. 10 graphically illustrates three phases of a CCR™ retort based on the temperature of the entrance to the vapor production well tubing.

CCR™ retort design and operation in general may be affected by three distinct operational phases related to the temperature of the gases leaving the retort into the vapor production well. The three phases are related to the retort temperature profile at the entrance to the vapor production well. The time-dependence of that temperature is characterized by two thermal waves and three plateaus shown schematically in FIG. 10, and the three operational phases correspond to the three plateaus. The highest-temperature plateau, closest to the heater well, is controlled by the oil refluxing wave. The next thermal plateau (in the direction of the flow) is controlled by the water refluxing wave. The lowest-temperature plateau is controlled by the sensible heat of the vapors. As time progresses, the steam and oil refluxing waves move upward with the flow of vapors at velocities governed by several coupled thermal parameters. Phase 1 corresponds to an exit temperature approximately equal to the ambient rock temperature. Phase 2 corresponds to the dew point of water at the retort pressure. Phase 3 corresponds to the oil boiling temperature. Contours in the left figure represent the approximate extent of the 300° C. temperature front during the three phases.

As mentioned above, the three operational phases differ in the temperature of the vapors leaving the retort and entering the vapor production well. In the first phase, the exiting non-condensable gases have completely deposited their heat into the formation, or nearly so, and the exit temperature is essentially at the un-heated shale temperature. In the second phase, the water refluxing wave has reached the outlet of the vapor production well and the exit temperature has reached the steam plateau level, which is in the range of 180 to 290° C. for the retort pressure range of 150 to 1100psig. Large amounts of water vapor exit through the vapor production well outlet during the second phase. The third phase is characterized by the oil refluxing wave filling the entire retort. The oil refluxing wave brings about heating to pyrolysis temperature in the range of 325 to 350° C. Temperatures near the entrance to the production well are high enough to carry all the water in that vicinity out of the retort in vapor form. For the higher well pressures, only the lighter oil fractions of produced shale oil participate in the oil refluxing mechanism. With continuous generation of full-boiling range shale oil, the high-boiling components will build up in the oil pool if not removed through a liquid production tube within the oil pool. Alternatively, the high-boiling components could be allowed to crack to the lighter components that participate in the refluxing mechanism.

During the first phase, steam condenses into liquid water and accumulates in the upper portion of the retort. In a stable flow mode, the liquid water trickles down the wall until it re-vaporizes due to heat exchange against the flowing vapors from below. However, flow instabilities may lead to liquid water penetrating all the way down to the oil pool, where it will finally re-vaporize. If return of liquid water to the oil pool is large, water can become the dominate component surrounding the heater and cool down the entire oil pool to the water boiling temperatures, which is as low as 180° C. (low pressure case). Consequently, there may need to be a means for removing excess water from the retort. This could be accomplished by either pumping liquid water through the liquid production line below the elevation of the heater or by moving the entrance of the production well tubing away from the heater as a function of time so that it always stays in the steam plateau region, i.e., the second operational phase.

In the final phase large amounts of refluxing oil are also carried out as vapor. Hence, operation in this mode is limited to the available oil inventory, unless this phase can be prolonged by replenishment of oil to the oil pool from the surface or directly from the transport pipe between the production tubing inlet and the surface. In contrast to oil refluxing within the retort, this oil flow is called "oil recycle". It can be "internal" if the recycle occurs from the piping system in the cased vapor production well, or "external" if the recycle occurs from the surface facility. As an alternative to recycling oil, the retort could be shut down when the oil pool dries up. Such a strategy would require an optimized design of the vapor production wells minimizing channeling leading to premature termination of the retort. Alternatively, the retort operation can continue through the recycling of liquid oil into the heater region. The recycled oil can even be injected at a temperature above the normal operation of the boiling oil pool to provide supplemental heat input. However, it is desirable that the design produces favorable vapor flow patterns so that a significant fraction of the heat is absorbed at the retort boundary, and not merely recycled from underground to surface and back. Having an adjustable oil vapor draw location would provide additional means for thermal efficiency optimization.

Figure 11:
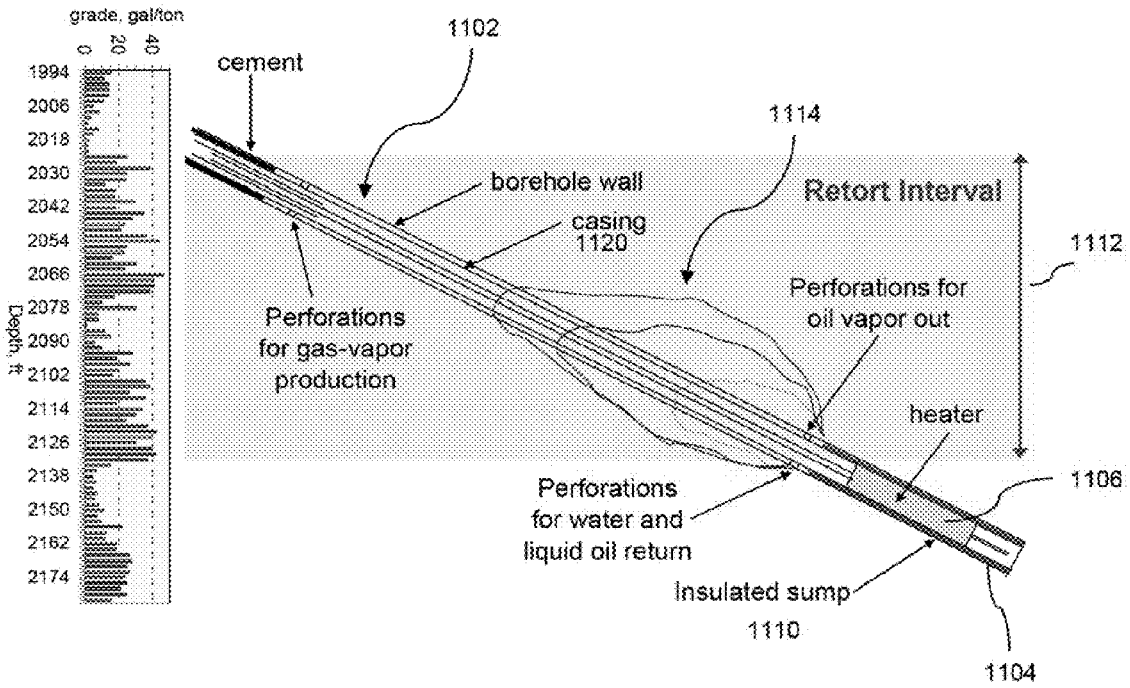
FIG. 11 shows the placement of an inclined heater-production well in the stratigraphy of the R-1 Zone.

In one design shown in FIG. 11, a relatively long inclined well 1102 is used to maximize the opportunity for heat exchange with the formation so as to stay in operational Phases 1 and 2 for the longest possible time to minimize the need for oil recycling. Liquid oil and water are pumped from the bottom of the sump 1104 containing the heater 1106. That sump and heater are in a low-grade oil shale zone 1110 below the primary retort target 1112. Insulation minimizes the heat transfer between the boiling oil and the surrounding oil shale.

The hot oil vapors exiting the heater 1106 will heat shale around the borehole initially to the spalling temperature and eventually to the pyrolysis temperature. The retorted zone 1114 will grow along the exposed borehole, presumably at a faster upward than downward rate. In this case, the preferred primary retort target 1112 is the interval between 2080 and 2130 feet, although the cemented casing 1120 will more likely extend to a depth of about 2050 ft, which is about 200 ft below the dissolution surface.

Figure 12:
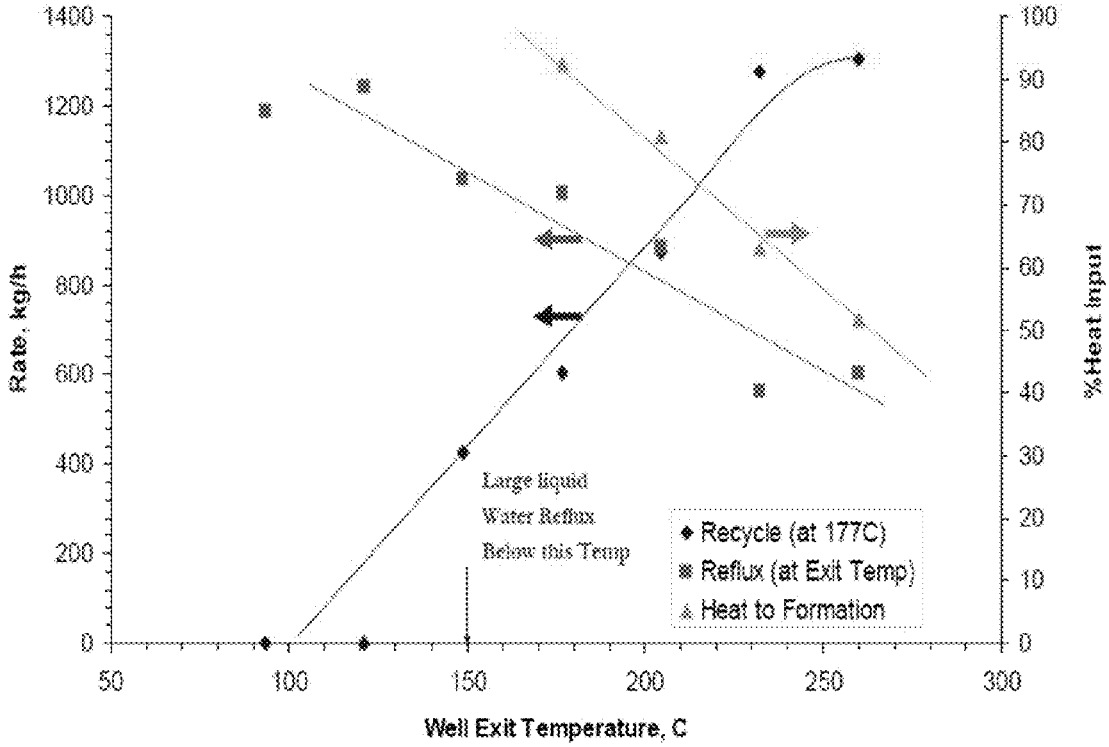
FIG. 12 is a graphic showing that the amount of recycled oil depends on the temperature at the entrance of the production well tubing.

The amount of recycled oil required depends on the temperature at the entrance to the production well tubing, as shown in FIG. 12. During Phase-1 operation, there should be limited or no recycle from the surface. The primary method of oil and water production will be as a liquid from the sump. The oil production rate at the exemplary design heater capacity of 325 kW is approximately 30 bbl/day, but the previously described issue of drying more shale that retorting shale may limit the oil production to no more than approximately 15 bbl/day. Water production may be as large as 25 bbl/day. As noted above, these capacities and production rates may be scaled. For instance, on a commercial scale these rates could be ten or more times larger.

As the exit temperature from the retort zone (entrance to the production pipe) reaches 177° C., the water production shifts from liquid to vapor in Phase-2 operation when the retort pressure is 150 psi. Due to the large amount of naphtha stripped from the retort by the water vapor, recycle naphtha from the surface facility is required to replenish the oil pool in the heater well to keep it from drying up. From a retort heat balance point of view, this recycle naphtha is preferably preheated at the surface facility to the retort exit temperature (otherwise heat delivery to the retort drops by the sensible heat difference between recycle entry and recycle exit temperature from the retort). To maintain the oil pool and full heat delivery of 325 kW to the retort, recycle naphtha would have to increase, and in some estimates, the increase will be from about 75 bbl/day at 150° C. retort exit temperature to about 115 bbl/day at 177° C. retort exit temperature, assuming thermodynamic equilibrium between all products leaving the retort exit. Consequently, the surface facility should be capable of handling combined recycle oil plus pyrolysis shale oil rate in the wide range of expected production, such as from approximately 10-145 bbl/day to assure an adequate oil pool. However, depending on the number of wells, this capacity could be for example, one-hundred times larger. As the retort exit temperature at 150 psig increases above 177° C., the transition to Phase-3 operation occurs. Naphtha recycle would have to increase, and in some estimates, the increase will be from approximately 180 bbl/day at around 200° C. to approximately 415 bbl/day for a 260° C. exit temperature. The recycle need decreases as the retort pressure increases.

The highest thermal efficiency process is one that operates in Phase 1 for the longest possible time. Heat losses due to transport to and from the surface by retort products are minimized, and the smallest-scale surface processing facilities are needed. Oil would be produced primarily as a warm liquid, and oil-gas separation needs would be minimal. This implies the longest possible transit distance between the region to be retorted and the entrance to the insulated vapor production tubing. Thermal losses from the retort boundary become relatively smaller as the cavity grows larger, and if adjacent retorts merge, as in the conceptual process shown in FIG. 3, the lateral heat losses are recouped, and edge effects become progressively smaller as the thickness of the shale processed becomes larger.

In the final stages of the retort, it is important that the entire retort cavity increase in temperature to the boiling point of oil, because it is likely that the porous shale near the bottom of the retort will hold up substantial amounts of oil and prevent it from draining to the sump for production as a liquid. Consequently, the entrance to the vapor production piping should increase to the boiling oil pool temperature. However, this could be a relatively short portion of the retort lifetime if designed with that objective. A relatively small facility for flash separation of streams with both gas and substantial amounts of oil vapor would be required to service retort panels near their end of production.

Figure 13:
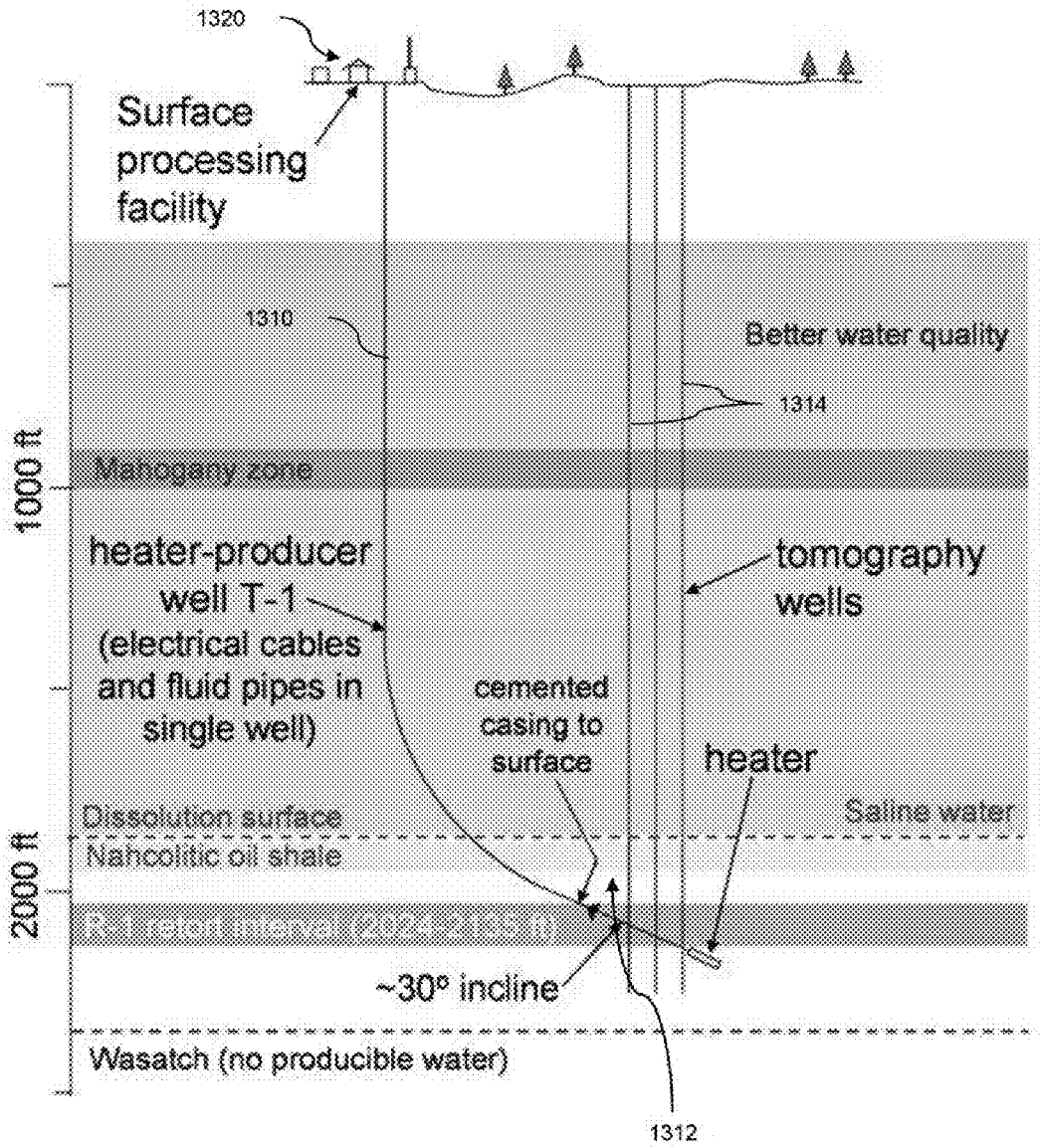
FIG. 13 is a schematic representation of an exemplary well implementation.
Figure 14:
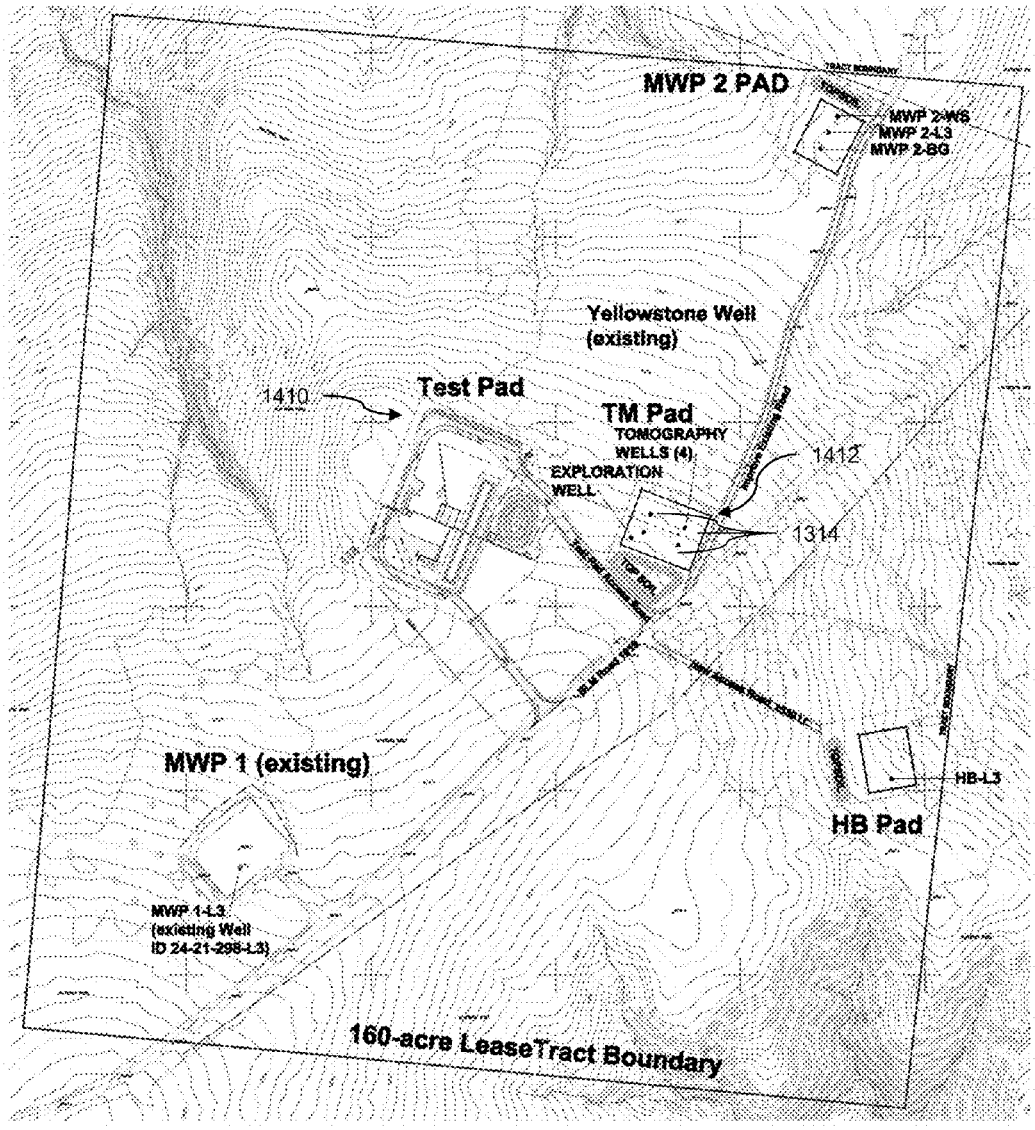
FIG. 14 is a site plan for the exemplary well implementation shown in FIG. 13.
Figure 15:
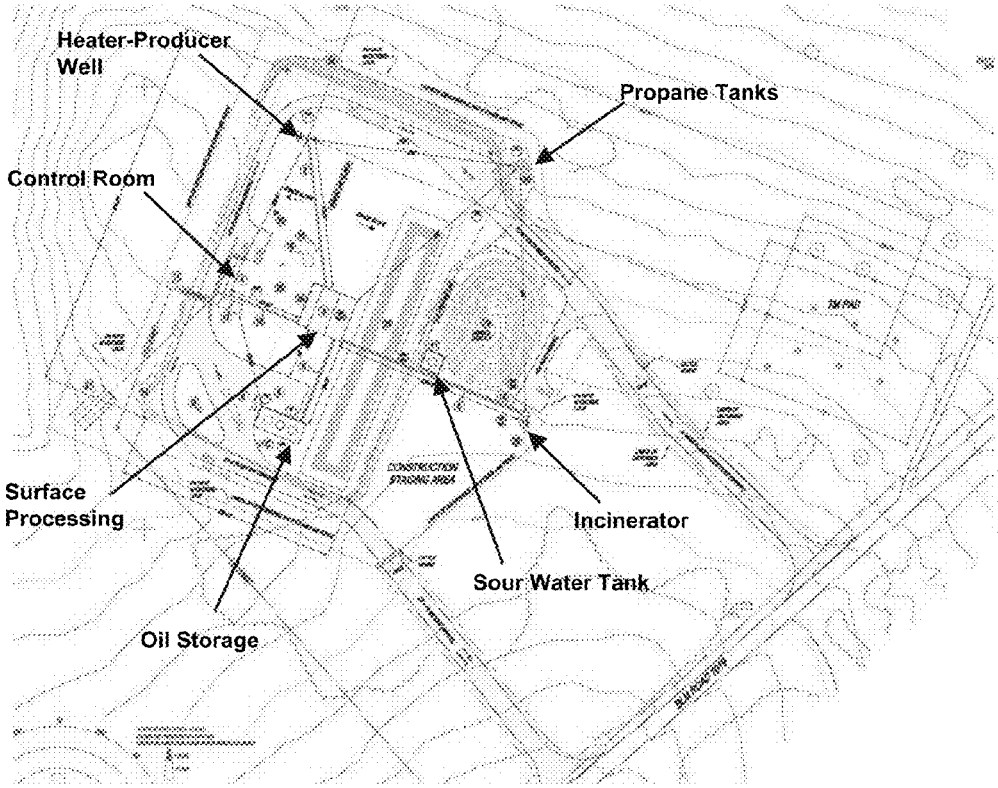
FIG. 15 is an enlarged view of the well area with key process components identified.
Figure 16:
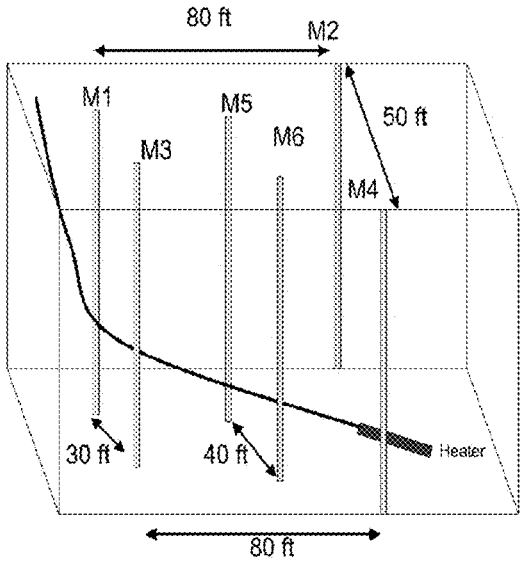
FIG. 16 illustrates an exemplary layout for possible locations of the tomography wells around the heated zone.

FIG. 13 schematically represents an example single heater-producer well 1310, a retort region 1312 surrounded by six tomography wells 1314, and surface facilities 1320 for processing the produced oil, water, and gas. The equipment is perhaps best described within the context of a site plan, which is shown in FIG. 14. An expanded view of the Test Pad area 1410 is shown in FIG. 15. The test pad contains the heater-producer well 1310 and the facilities 1320 for processing the produced fluids. The retort 1312 is below the TM pad 1412 and is surrounded by six tomography wells 1314 (four wells shown). Various well spacings are contemplated, such as a uniform distance between wells and an expanding pattern shown in FIG. 16, on the presumption the retorted zone is pear-shaped. Preferably, the heater is placed in a sump just below the R-1 Retort Zone (see FIG. 13), and oil vapors will exit out of the heater into the R-1 Retort Zone as shown schematically in FIG. 11.

Figure 17:
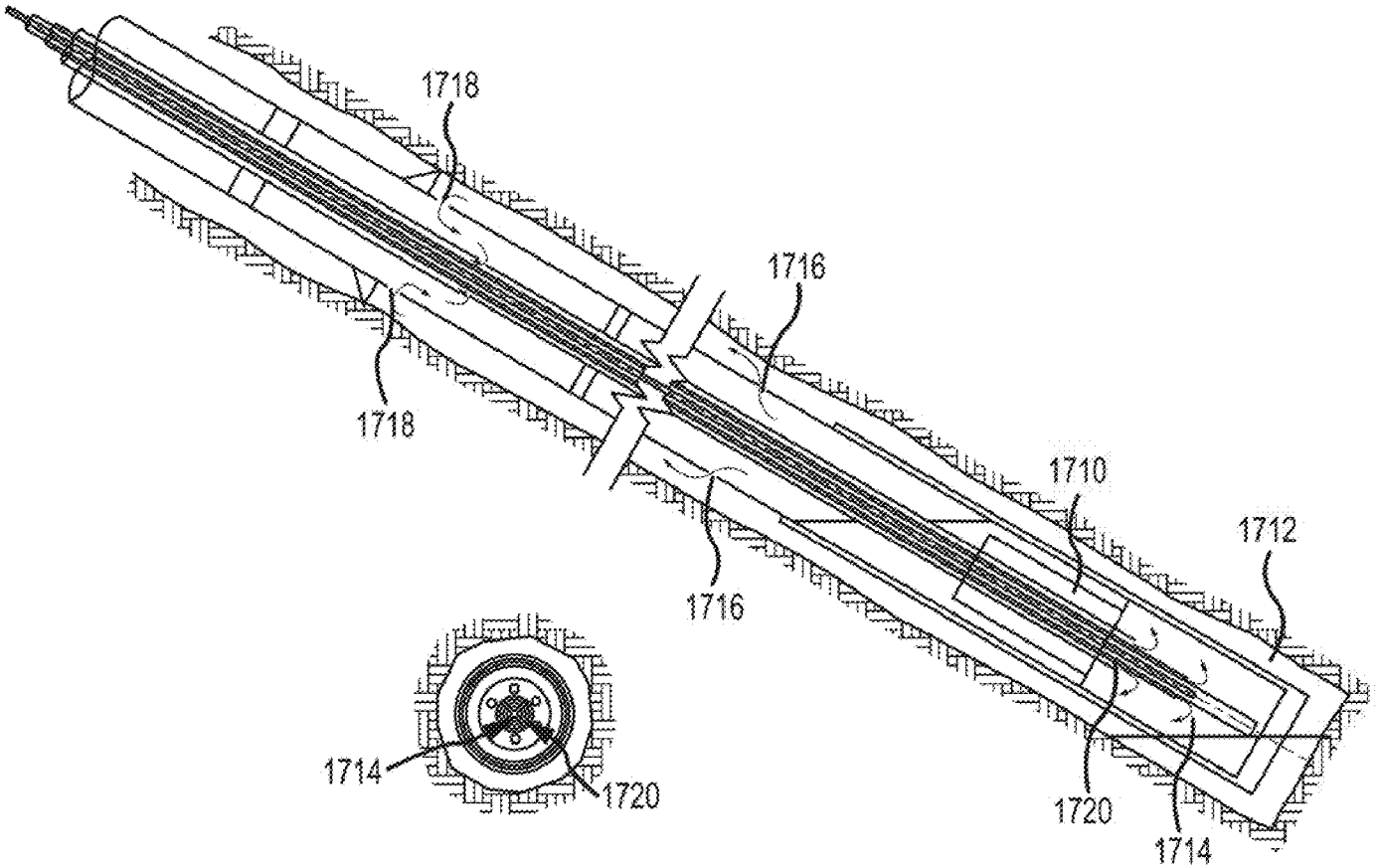
FIG. 17 is an illustration of the heater and well completion within the retort.
Figure 18:
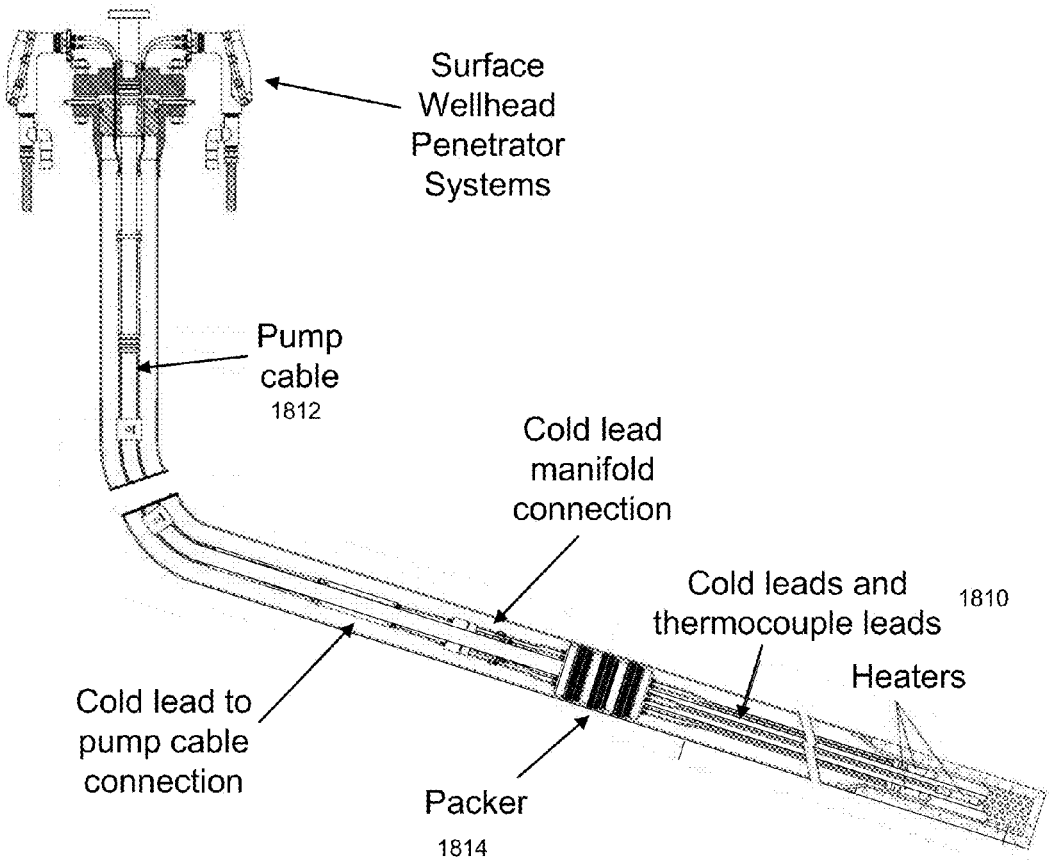
FIG. 18 is a conceptual design of the heater electrical connection system.
Figure 19:
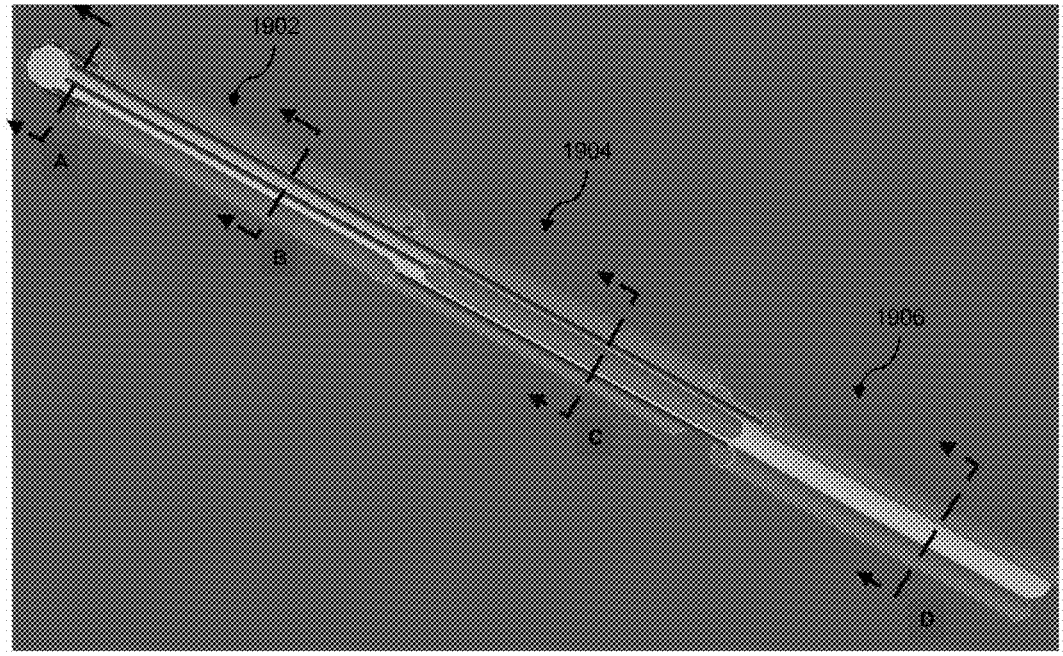
FIG. 19 illustrates the electric heater's three banks of three heater elements.

With reference to FIGS. 17 and 18, the primary heat source for the retort is an electric heater 1710. An example of a suitable heater design is the Tyco Thermal Systems. Referring to FIG. 18, a cold lead 1810 is a metal-oxide-insulated cable that can withstand high temperatures but does not generate heat itself. The 3-phase power to the heaters is supplied by a standard pump cable 1812. The heater is in a sump below the intended retort region and supported by a 4" "stinger" tube that extends to the surface. As represented in FIG. 19, the Tyco electric heater consists of three banks of three heater elements 1902, 1904, and 1906. Each set of three elements is powered by 480-volt 3-phase electric power. The casing extending through the retort interval is not cemented. The casing is cemented at the top of the retort, which is the top of R-1. A packer 1814 slightly above that casing shoe prevents vapors from the retort from entering the annulus between the stinger pipe and the cemented casing.

Returning briefly to FIG. 17, oil and water drain from the retort into the sump 1712. A 1.6" internal diameter tube 1714 extends down into the sump and is used to produce liquid oil and water. It serves the function of preventing water buildup that could lead to the oil pool switching into a water-boiling mode, which operates at too low of a temperature to pyrolyze the shale. The pump is, for example, a gas-piston type pump or a gas lift type pump.

Hot oil vapors exit the casing surrounding the heater through perforations 1716 near the bottom of the retort interval. A packer above those perforations prevents the vapors from traveling up between the production tubing and the casing. The vapors within the retort heat and pyrolyze the shale surrounding the casing. Noncondensible gases and oil and water vapor re-enter the casing through perforations 1718 near the top of the retort interval. Vapors that condense in the production annulus are directed down to below the heater through that same annulus. A packer just below the upper perforations accomplishes the liquid vapor separation and prevents oil from draining down into the hot casing through the retort.

Figure 20:
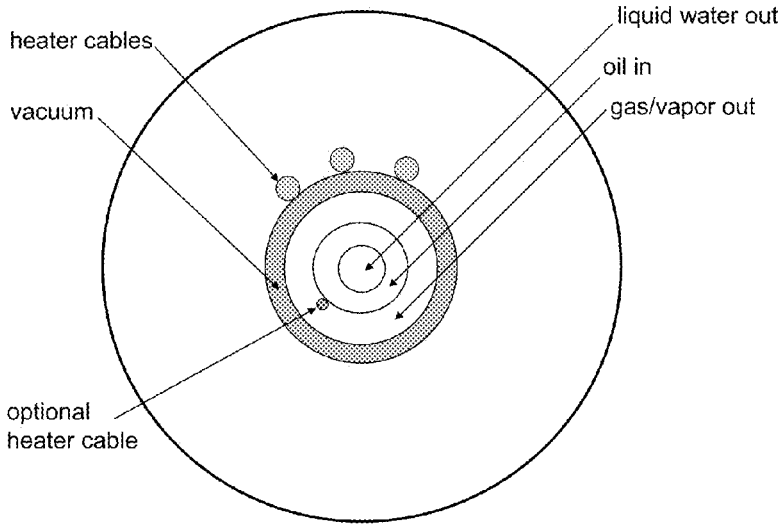
FIG. 20 is an exemplary production tubing configuration above the packer and cable transition.

A second annulus is provided by a 2.44" internal diameter tube 1720 between the liquid production tube and the stinger tube. The inside annulus is used to recycle oil from the surface to below the heater in order to maintain the boiling oil pool. A schematic cross section of this is shown in FIG. 20. The electrical cables are separated from the hot oil and vapor tubing by a vacuum-insulated tube or other insulated pipe string. A metal-oxide-insulated heater cable may be used to keep the production string warm to prevent refluxing.

Figure 21:
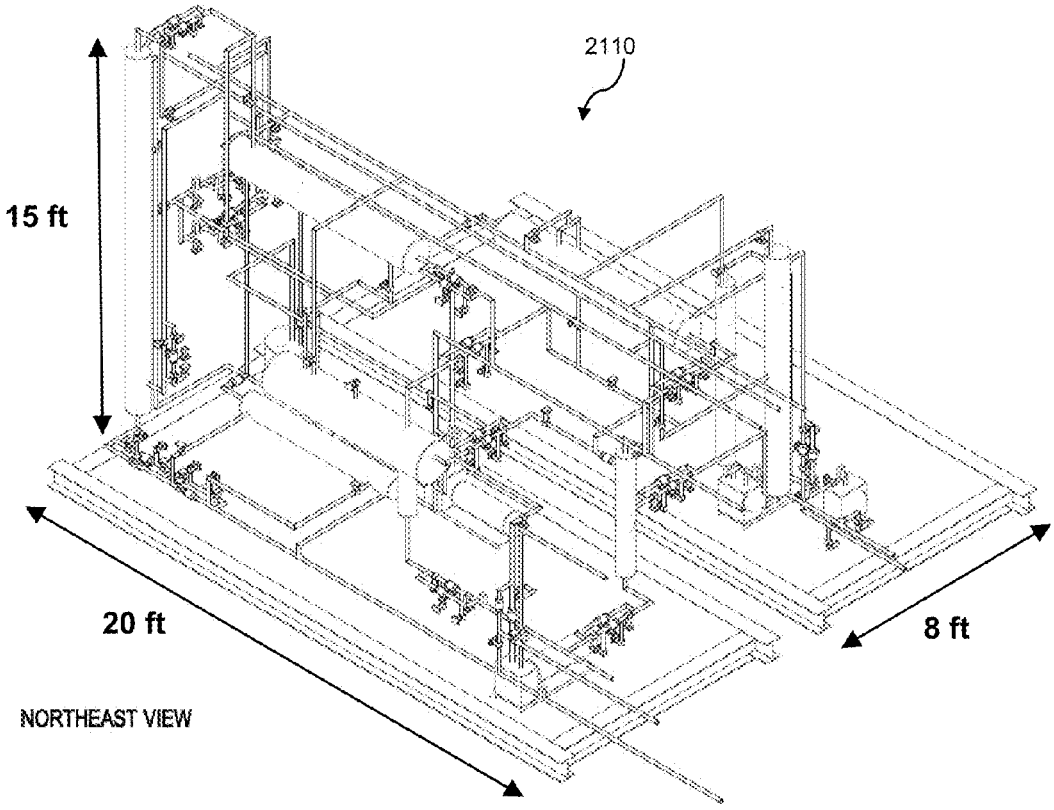
FIG. 21 is a perspective view of an oil-water-gas fractionation system.

The surface processing facilities separate the produced fluids into light and medium oils, sour water, and sour gas. Either oil fraction can be heated and recycled to the submerged heater. The gas is sent to an incinerator, and the water is sent to a sour water tank, where it can metered into the incinerator. The oil is collected in tanks. Large oil samples can be transferred into trucks for off-site studies or use, and excess oil can be sent to the incinerator. An exemplary design for a suitable oil-water separation system 2110 is shown in FIG. 21. The equipment fits on two 8-ft by 20 ft-skids and is preferably contained inside a well-ventilated building.

In another embodiment the CCR™ retorting process is also implemented in Colorado's Piceance Basin. In this embodiment, the mining interval is an approximately 120-ft thick section extending from a depth of about 2015 to about 2135 feet.

Figure 22:
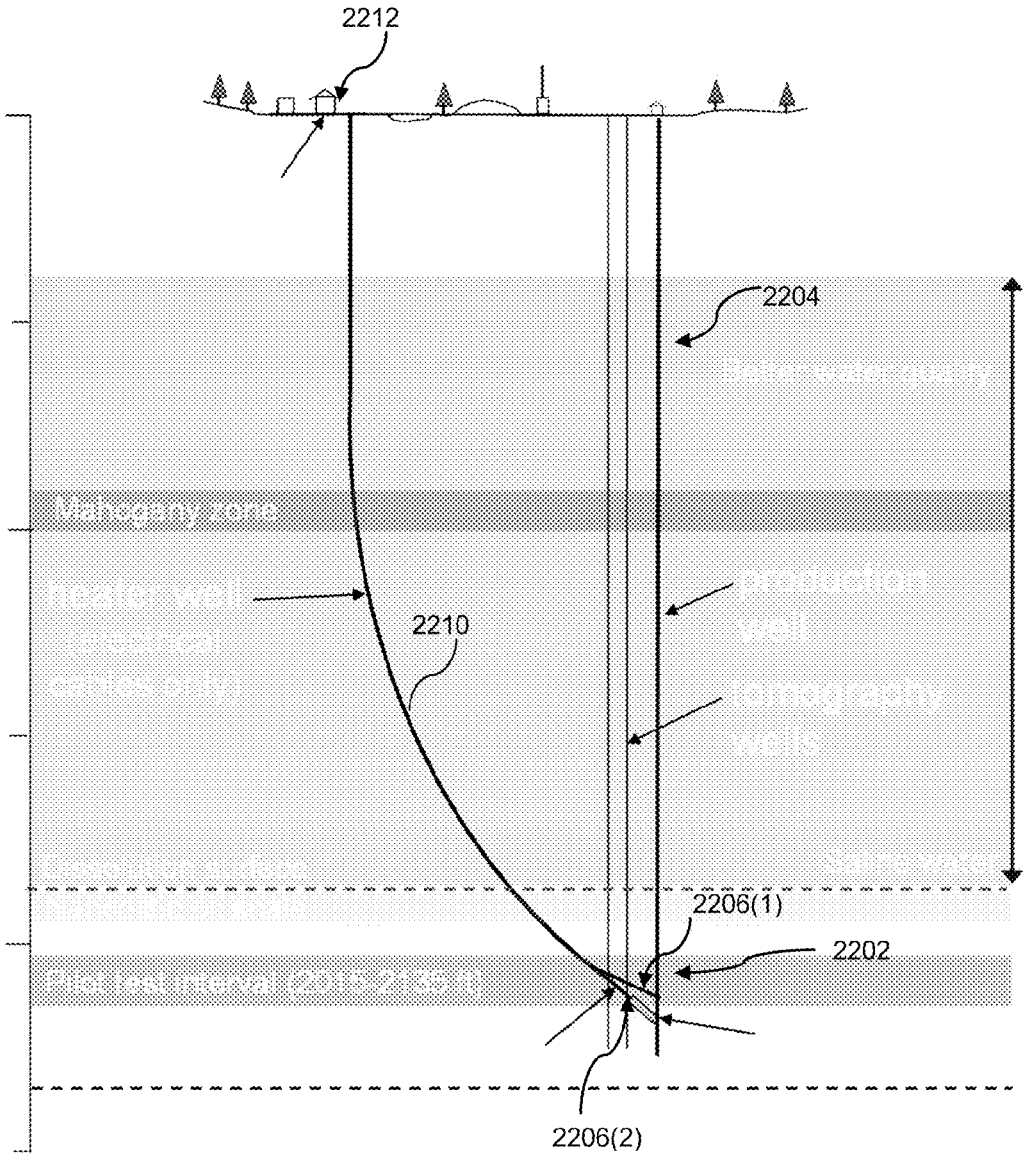
FIG. 22 is a schematic representation of an alternative exemplary well implementation.
Figure 23:
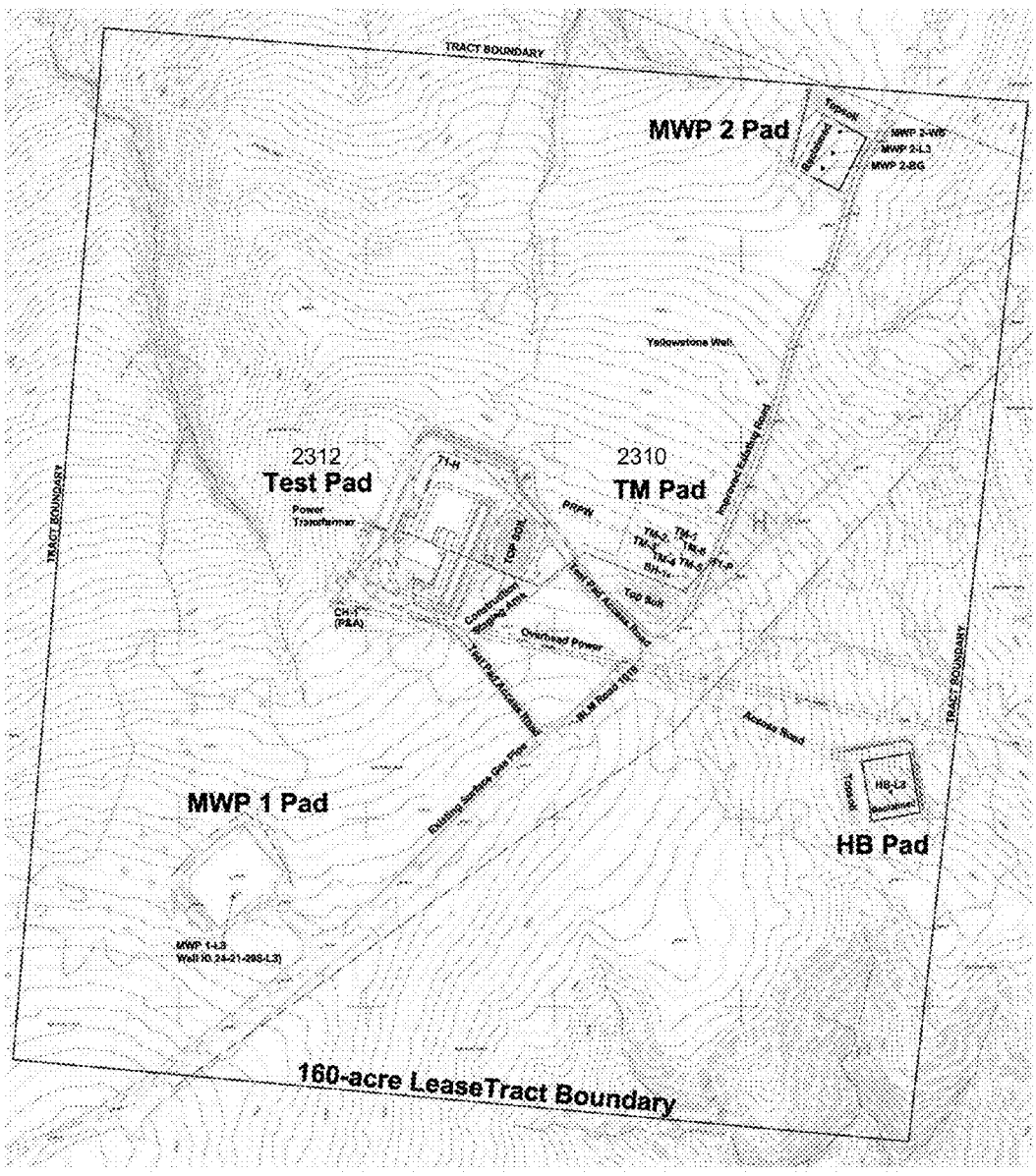
FIG. 23 is a site plan for the exemplary well implementation shown in FIG. 22.
Figure 24:
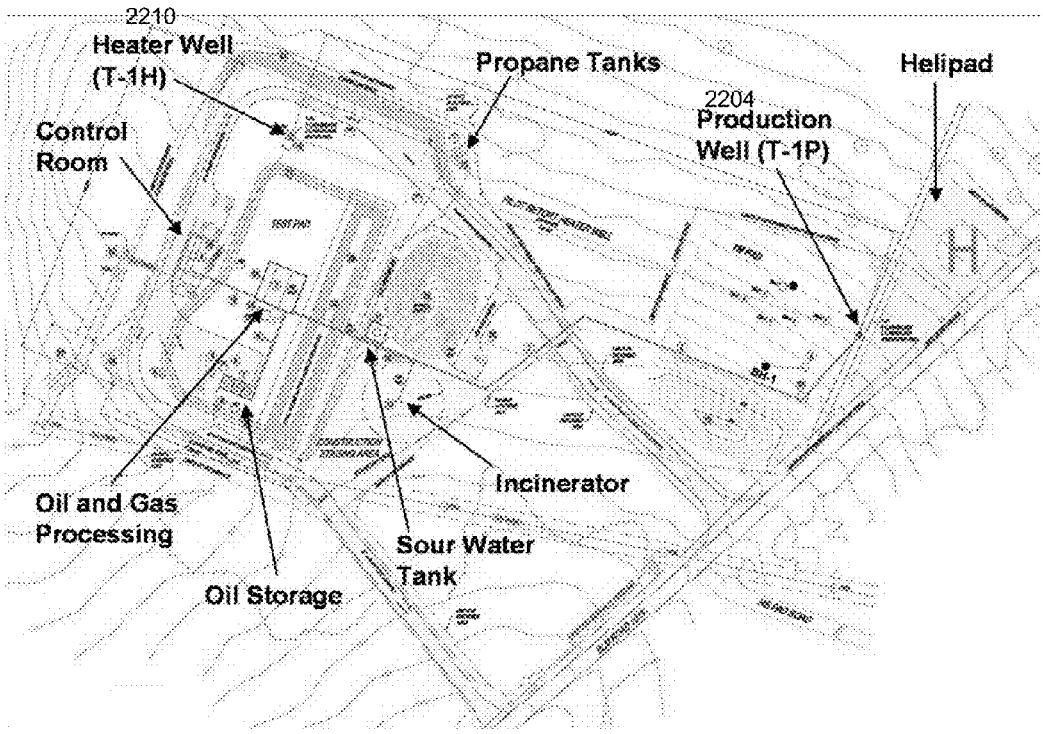
FIG. 24 is an enlarged view of the well area shown in FIG. 23 with key process components identified.
Figure 25:
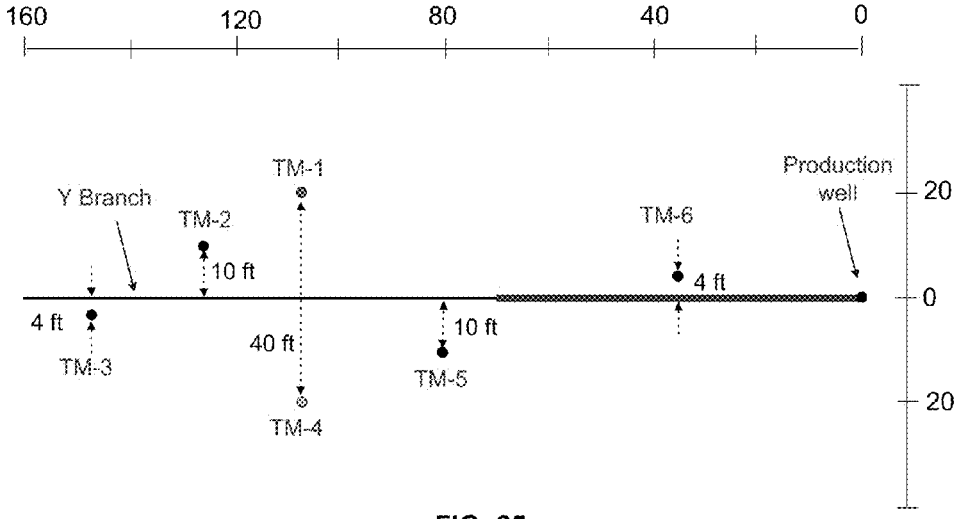
FIG. 25 illustrates an exemplary layout for possible locations of the tomography wells shown in FIG. 22.
Figure 26:
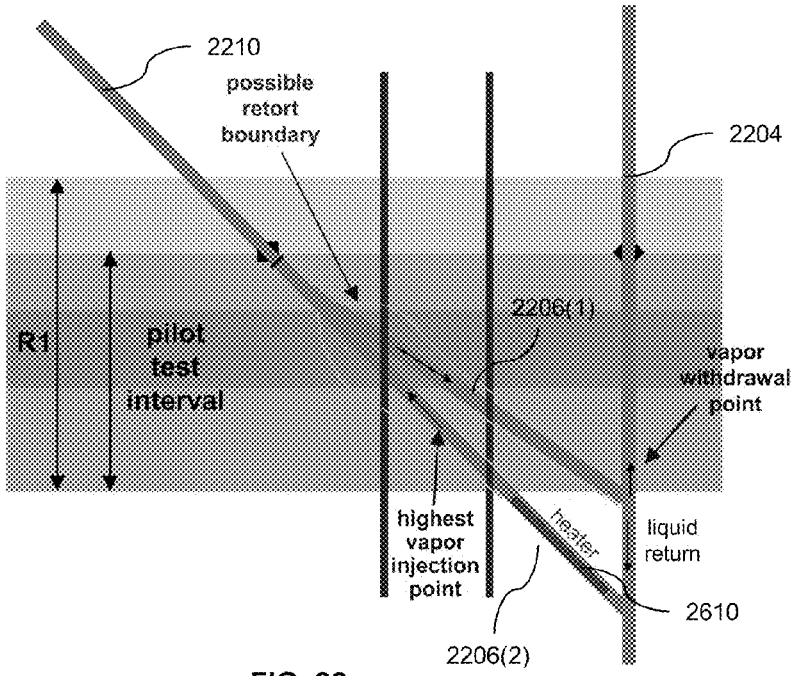
FIG. 26 is a schematic depiction of an alternative embodiment of a retort production well including an inclined heater well and vertical production well.

In this embodiment the retort 2202 is located near the intersection of a vertical production well 2204 connected by two branches 2206(1) and 2206(2) of a deviated heater well 2210 as shown in FIG. 22. The overall site plan for this embodiment is shown in FIG. 23. The vertical production well 2204 is installed on the TM Pad 2310 while the deviated heater well 2210 is installed on the Test Pad 2312. An expanded view of the Test Pad and TM Pad area is shown in FIG. 24. In addition to the Heater Well, the Test Pad also contains the facilities 2212 for processing the produced fluids. The retort is below the TM Pad and is surrounded by a plurality of tomography wells as shown in FIG. 25. In this example, six tomography wells surround the retort. The precise number and locations of the tomography wells may be varied as conditions warrant. The heater 2610 is preferably placed in a sealed tubing just below the R-1 Zone, and oil vapors will exit out of the heater into the R-1 Zone as shown schematically in FIG. 26.

The surface processing facilities 2212 separate the produced fluids into light and medium oils, sour water, and sour gas. Either oil fraction can be heated and recycled to the submerged downhole electric heater. The gas may be sent to an incinerator, and the water is sent to a sour water tank, from which it is metered into the incinerator. The oil is collected in tanks. Large oil samples can be transferred onto trucks for off-site studies or use, and excess oil can be sent to the incinerator.

Figure 27:
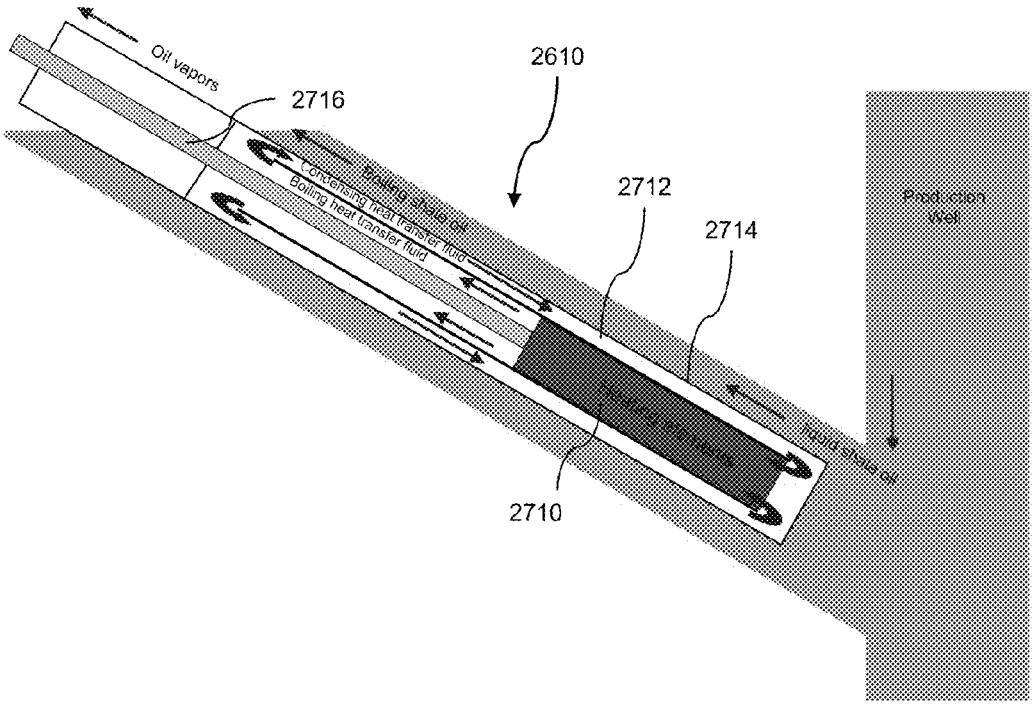
FIG. 27 is a conceptual diagram of the heater assembly shown in FIG. 26.
Figure 28:
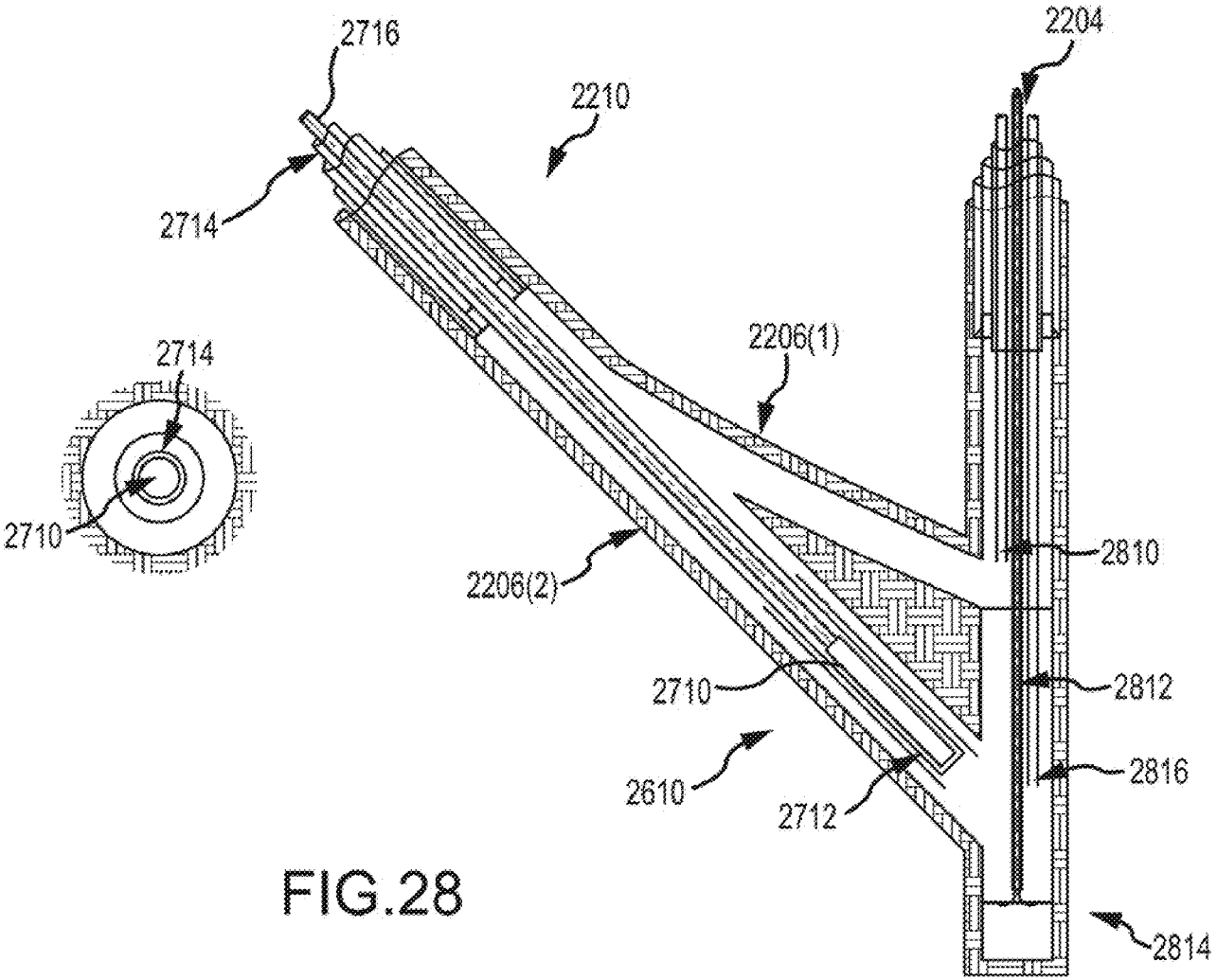
FIG. 28 is a detailed schematic representation of the retort production well configuration shown in FIGS. 26 and 27.

A heater assembly 2610 as shown in FIGS. 27 and 28 may be used to boil the shale oil. The heater assembly is comprised of electric heating elements 2710 and a heat transfer fluid 2712 contained in the sealed 'heater tubular' 2714—all of which is submerged in shale oil below the intended retort interval. The electric heating elements are attached to the 'heater umbilical' tubular 2716 (nominally 2⅜ in. as shown in FIG. 28) that extends to the surface. Sufficient heat transfer fluid is added to submerge the electric heating elements.

Referring to FIG. 28, the heater assembly boils the shale oil providing hot vapor to heat the retort. The vapors provide both sensible heat and latent heat. The condensing vapor provides the latent heat. The condensate flows back to the boiling oil pool where it will either be pumped to surface in the 'production liquid tubular' 2812 from the sump 2814 near the bottom of the Production Well as part of a water/oil mixture or boiled again by the heater assembly. The 'surface reflux' tubular 2816 is used to recycle oil from the surface processing facility back into the retort. These two tubulars are used together to maintain the correct level of oil in the retort. The 'vapor out tubular' 2810 is used to conduct non-condensing vapors to surface. Boiling the oil pressurizes the test retort, and the retort pressure is controlled primarily by throttling the vapor in this tubular at the surface.

Figure 29:
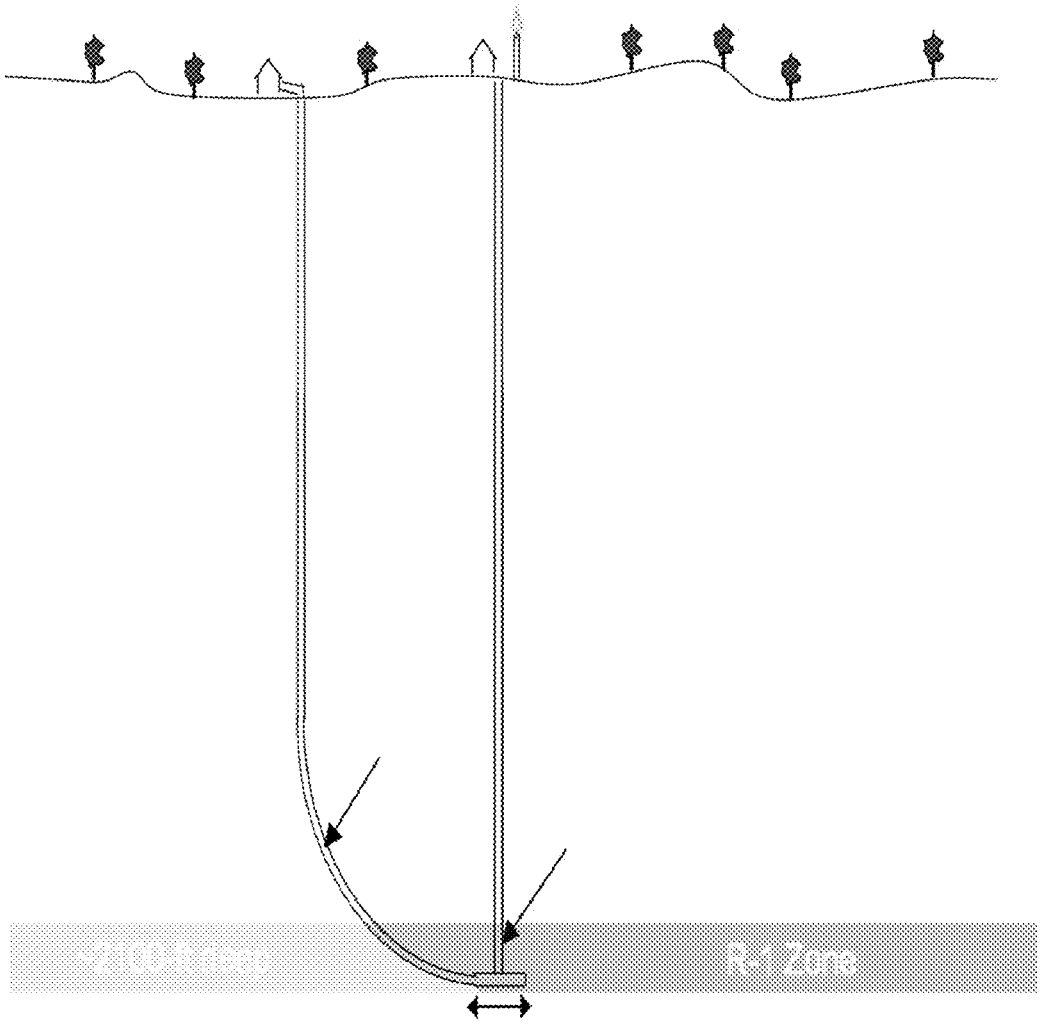
FIG. 29 is a schematic representation of an alternative exemplary embodiment of a well configuration for implementing a CCR retort.
Figure 30:
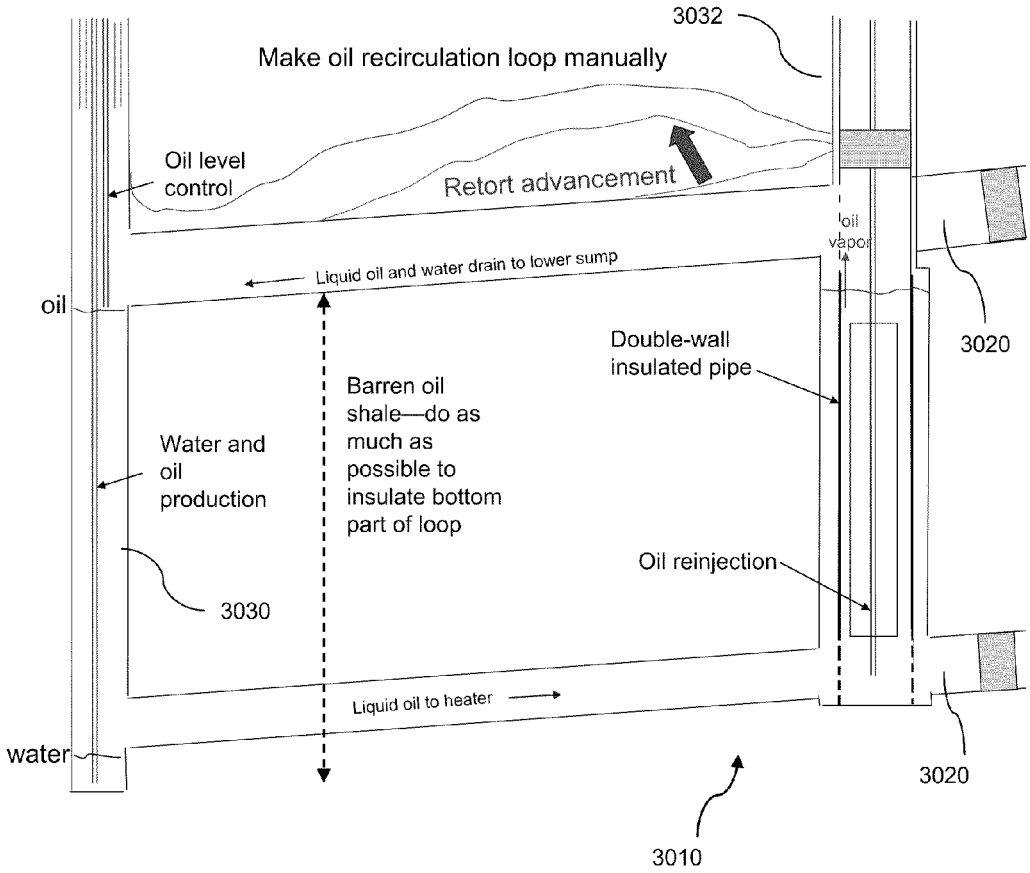
FIG. 30 is a schematic representation of another alternative exemplary embodiment of a well configuration for implementing a CCR retort including a heat transfer convection loop.

FIGS. 29-30 illustrate several alternative well configuration geometries in which to facilitate convective heat transfer in the retort. For example, FIG. 29 illustrates a 100 foot long CCR™ retort along a horizontal portion of a heater borehole. In this configuration the shale oil is produced through a vertical production well. FIG. 30 illustrates a heat-transfer convection loop 3010 that is enhanced by drilling a circulation pattern with a branched horizontal well 3020 and two vertical wells 3030, 3032. It should be appreciated that the triangular and quadrilateral convection loops shown in the figures are only examples of geometries that could be formed that enhance convection.

Accordingly, the technology of the present application has been described with some degree of particularity directed to the exemplary embodiments. It should be appreciated, though, that the technology of the present application is defined by the following claims construed in light of the prior art so that modifications or changes may be made to the exemplary embodiments without departing from the inventive concepts contained herein.

What is claimed is:

1. A process for retorting and extracting sub-surface hydrocarbons, comprising:

drilling an energy delivery well extending from the surface to a location proximate a bottom of the hydrocarbons;

heating the hydrocarbons from the bottom to form a retort, said retort extending along a portion of said energy delivery well;

extending a vapor tube to a location proximate said retort, said vapor tube having an entrance corresponding to the region of the retort along said energy delivery well that is nearest the surface exit; and maintaining the temperature of vapor entering said entrance at a temperature approximately equal to unheated surrounding hydrocarbons.

2. The process according to claim 1 including removing excess water from said retort.

3. The process according to claim 1 including positioning a heater in said energy delivery well, and including moving the entrance of the vapor tube away from the heater as a function of time.

4. The process according to claim 1 including further heating said retort until said vapor entering said entrance reaches a temperature of between about 180 to 290 degrees C. at a pressure of between about 150 to 1100 psig.

5. The process according to claim 4 including further heating said retort to between about 325 and 350 degrees C.

6. The process according to claim 5 including recycling oil into the retort.

7. The process according to claim 6 wherein oil is recycled into the retort from the surface.

* * * * *